US006971795B2

(12) United States Patent
Lee et al.

(10) Patent No.: US 6,971,795 B2
(45) Date of Patent: Dec. 6, 2005

(54) SEISMIC ISOLATION BEARING

(76) Inventors: George C. Lee, 31 The Hamlet, East Amherst, NY (US) 14051; Zach Liang, 7185 Pendale Cir., North Tonawanda, NY (US) 14120; Tie-Cheng Niu, 103 Bassett Rd., Williamsville, NY (US) 14221

( * ) Notice: Subject to any disclaimer, the term of this patent is extended or adjusted under 35 U.S.C. 154(b) by 51 days.

(21) Appl. No.: 10/670,960

(22) Filed: Sep. 25, 2003

(65) Prior Publication Data

US 2004/0131287 A1 Jul. 8, 2004

Related U.S. Application Data

(63) Continuation-in-part of application No. 09/994,148, filed on Nov. 26, 2001, now abandoned, and a continuation-in-part of application No. 10/455,857, filed on Jun. 6, 2003, which is a continuation-in-part of application No. 09/994,148, filed on Nov. 26, 2001, now abandoned.

(51) Int. Cl.[7] ..... E04H 9/02
(52) U.S. Cl. ..... 384/36; 14/73.5
(58) Field of Search ..... 384/36; 14/73.5; 52/167.4–167.7; 248/562, 421, 638

(56) References Cited

U.S. PATENT DOCUMENTS

| | | | | |
|---|---|---|---|---|
| 1,761,660 A | | 6/1930 | Cummings | |
| 4,105,177 A | | 8/1978 | Smith et al. | |
| 4,462,955 A | | 7/1984 | Albin et al. | |
| 4,596,373 A | | 6/1986 | Omi et al. | |
| 4,687,174 A | * | 8/1987 | Helary et al. | 248/638 |
| 5,035,394 A | | 7/1991 | Haak | |
| 5,071,261 A | | 12/1991 | Stüve | |
| 5,357,723 A | | 10/1994 | Sasaki et al. | |
| 5,599,106 A | | 2/1997 | Kemeny | |
| 5,716,037 A | | 2/1998 | Haak | |
| 5,867,951 A | | 2/1999 | Yaguchi et al. | |
| 5,934,029 A | * | 8/1999 | Kawai et al. | 52/167.5 |
| 6,123,313 A | * | 9/2000 | Otsuka et al. | 248/580 |
| 6,321,492 B1 | | 11/2001 | Robinson | |
| 6,505,806 B1 | * | 1/2003 | Glaesener | 248/638 |

FOREIGN PATENT DOCUMENTS

| | | |
|---|---|---|
| EP | 0 439 272 A2 | 7/1991 |
| GB | 1091611 | 11/1967 |
| WO | WO 95/23267 | 8/1995 |
| WO | WO 01/42593 A2 | 6/2001 |

* cited by examiner

*Primary Examiner*—Thomas R. Hannon
(74) *Attorney, Agent, or Firm*—Hodgson Russ LLP

(57) ABSTRACT

A seismic isolation bearing comprises a lower plate, an upper plate, and a cylindrical roller in rolling contact with an upwardly facing, bearing surface of the lower plate and a downwardly facing surface of the upper plate. The lower plate is fixable to a base, while the upper plate is fixable to a superstructure. One or both bearing surfaces are sloped to form a central trough at which the cylindrical roller resides under normal weight of the superstructure, and toward which the roller is biased when displacement between the plates occurs. A pair of sidewall members are fixed to the lower plate to withstand strong forces directed laterally with respect to the isolation axis along which rolling displacement occurs, and a pair of sliding guides carried one at each end of the roller provide dry frictional damping as they engage an inner wall surface of a corresponding sidewall member.

68 Claims, 19 Drawing Sheets

SEISMIC ISOLATION BEARING

CROSS-REFERENCES TO RELATED APPLICATIONS

The present application claims benefit as a continuation-in-part of application Ser. No. 09/994,148 filed Nov. 26, 2001 now abandoned; and the present application claims further benefit as a continuation-in-part of copending application Ser. No. 10/455,857 filed Jun. 6, 2003, which itself is a continuation-in-part of the aforementioned application Ser. No. 09/994,148 filed Nov. 26, 2001 now abandoned.

BACKGROUND OF THE INVENTION

I. Field of the Invention

The present invention relates to devices for isolating structural members from seismic forces to minimize damage and reduce casualties in the event of an earthquake.

II. Description of the Related Art

A known design approach for improving structural response to earthquakes is based on the principle of seismic isolation, wherein energy is generally dissipated by mechanical dissipating devices such as lead cores within lead-rubber bearings, by friction in sliding bearings, or by special supplemental mechanical energy-dissipating devices such as steel, viscous or visco-elastic dampers. In order to prevent damage to main structural components, large horizontal displacements must be accommodated in the isolation bearing system.

Elastomeric isolation bearings according to the prior art typically comprise upper and lower metal plates separated by a layer of elastomeric material that allows relative horizontally directed movement between the plates and generates a restorative force. A recognized drawback of these bearings is that they must be very tall to allow for seismically induced lateral displacements of one to two feet.

Conventional sliding isolation bearing systems include an upper portion and a lower portion intended for sliding displacement with respect to the upper portion incident to horizontally directed ground excitations transmitted to the lower portion of the bearing. In a typical design, for example as described in U.S. Pat. No. 5,867,951, the upper portion of the bearing includes a downwardly facing concave surface, such as a spherical surface, that is engaged by a bearing element having a contact surface of low-friction material. Sliding isolation bearings of this type are space-inefficient because the concave surface of the upper portion must be large enough to accommodate horizontal movement in all directions, thus making the upper portion unduly large. This can be a significant disadvantage where space restrictions apply, such as with a highway overpass bridge where the bridge pier is of limited width dictated by the traversed lanes of highway. It has also been recognized that the resonant frequency of the oscillatory sliding bearing could be matched by the earthquake, leading to dangerous displacements. Another disadvantage is apparent after an earthquake has occurred: displacement is permanent, and hydraulic jacks are required to return the displaced structure to its original position, if this is possible.

Other isolation bearings allow for linear motions along orthogonal X and Y axes to achieve a resultant horizontal displacement.

U.S. Pat. No. 4,596,373 to Omi et al. describes an isolation bearing comprising a base, a pair of parallel X-axis rails fixed to the base, X-axis linear motion means slidably mounted on each X-axis rail, a pair of parallel Y-axis rails fixed to the X-axis linear motion means, Y-axis linear motion means slidably mounted on each Y-axis rail, and a top platform 8 mounted on the Y-axis linear motion means. Thus, horizontal displacement between the base and the platform results from a combination of X and Y motions to isolate structure supported on the platform from ground motions transmitted to the base. Friction dampers and tension springs are associated with the X and Y linear motion means to establish a linear oscillation system without the use of rollers.

U.S. Pat. No. 5,035,394 to Haak discloses an isolation bearing comprising lower, intermediate and upper levels. An interconnection between the upper and intermediate levels includes tracks and bearings riding on the tracks to permit relative motion along a first axis, while a similar interconnection between the intermediate and lower levels permits relative motion along a second axis perpendicular to the first axis. The isolation bearing further comprises spring-biased centering and restoring mechanisms between the upper and intermediate levels and between the intermediate and lower levels.

U.S. Pat. No. 5,716,037, also to Haak, teaches another three-level isolation bearing. The upper level includes two parallel guide bars fixed to an undersurface thereof for receipt by parallel rows of roller bearings on a top surface of the intermediate level to enable relative linear motion along a first axis. The intermediate level further includes opposing V-shaped cam tracks between the rows of roller bearings for receiving a spring-loaded roller-follower carried by the upper lever, whereby the upper level is urged to a neutral axial position relative to the intermediate level, and a similar restoring arrangement is provided with respect to the lower and intermediate levels.

U.S. Pat. No. 5,357,723 discloses an isolation bearing with damping capability characterized by plates having rollers therebetween, wherein the plate surfaces in contact with the rollers are provided with an elastomeric damping surface portion or portions 5, and a rigid surface portion or portions 6.

Finally, in International Patent Application Publication No. WO 01/42593 by the Applicants herein, a self-restoring three level isolation bearing is described wherein rollers are confined in rolling engagement between opposing linearly sloped wedge surfaces of a lower assembly and an intermediate assembly for self-restoring motion along an X-axis, and a similar arrangement is provided between the intermediate assembly and an upper assembly for self-restoring motion along a Y-axis. While this arrangement is efficient in its use of space for a two-axis isolation system and is effective in reducing the absolute acceleration of the superstructure which it supports, it is less than optimal as a solution for bridge isolation, as compared to building isolation. The disclosure of International Patent Application Publication No. WO 01/42593 is hereby incorporated by reference into the present specification.

FIGS. 1A and 1B are explanatory prior art diagrams illustrating the arrangement of isolation bearings with respect to a building (FIG. 1A) and a bridge structure, for example a highway bridge (FIG. 1B). Base isolation for buildings can be summarized by a simple objective, namely, to reduce the absolute acceleration of the superstructure. Here, superstructure means any portion of a structure above the isolation bearings. The reduction of the absolute acceleration is automatically equivalent to a reduced level of earthquake excitation onto a regular building structure without isolation bearings. However, the problem of bridge isolation is much more complex. In many circumstances, if not all the cases, reducing the acceleration of the bridge deck should not be the goal. Instead, the main goal is to reduce the seismic load on the support columns which is caused by the inertial load due to the heavy weight of the bridge deck under seismic excitation. The difference between base isolation of a building and bridge isolation is illustrated by FIGS. 1A and 1B, wherein the mass of the superstructure is denoted as $m_s$, and the damping coefficient and stiffness (spring constant) of the bearings are denoted as $c_b$ and $k_b$, respectively. In the building isolation schematic of FIG. 1A, the absolute acceleration of the superstructure is denoted as $x_{abs}''$ and the relative displacement of the bearing is denoted as $x_{rel}$. Equating the inertial force of the superstructure with the damping and restoring force generated by the isolation bearing, the system is described by the equation:

$$m_s x_{abs}''+c_b x_{rel}'+k_b x_{rel}=0$$

However, in the case of bridge isolation shown in FIG. 1B, the superstructure is supported by a pier or column which has its own damping coefficient $c_p$ and stiffness $k_p$. The relative displacement between the top of the pier and the ground is denoted by $x_p$. In this case, the system is described by the equation:

$$m_s x_{abs}''+c_b x_{rel}'+k_b x_{rel}+c_p x_p'+k_p x_p=0$$

Thus, the equation describing bridge isolation includes two additional terms not found in the building isolation system. From the equation describing bridge isolation, it can be understood that reduction of the acceleration $x_{abs}''$ may not be directly related to the reduction of bearing displacement $x_{rel}$, nor to the reduction of the pier displacement $x_p$. However, the reduction of bearing and pier displacements can be more important than reduction of the absolute acceleration of the superstructure.

Consequently, for building isolation, the fundamental period of the isolation system is adjusted by varying the stiffness of the bearing and the bearing displacement is controlled by adjusting the damping coefficient of the bearing. The design principles for building isolation are clear and straightforward. However, for bridge isolation, a compromise must be struck between the goals of limiting bearing displacement and reducing the force applied to the pier. In most cases, the main purpose of bridge isolation should be reduction of both the base shear and the bearing displacement. Therefore, the working region of a bridge isolation bearing can be quite different from that of a building isolation bearing.

Note that the aforementioned compromise can often be achieved by taking advantage of the special design of specific bridge piers and decks. For example, a certain pier can have drastically different stiffness and strength along perpendicular (X- and Y-) axes. For example, the stiffness and strength of a pier along the X axis can be large enough, like a shear wall, such that isolation is not needed along the X axis and the goal is to limit the X-axis bearing displacement. The isolation bearing embodiments described in International Patent Application Publication No. WO 01/42593 are designed to have the same performance characteristics along the X axis as they do along the Y axis, making it difficult to realize the goals of bridge isolation.

Another problem not solved by the embodiments shown in WO 01/42593 relates to stability of the bearing in the event of normal light horizontal loads, such as wind, traffic, etc. The isolation bearing should be locked against movement for light horizontal loads encountered under normal conditions, but should also provide isolation during an earthquake.

The isolation bearings described in WO 01/42593, and many other prior art isolation bearings for that matter, are not adequately designed with respect to the reduction of large bearing displacement, a factor that is especially important for bridge isolation. Large bearing displacements occur for two main reasons. The first reason is a built-in problem of conventional linear (or slightly non-linear) bearings: the phase of the motion of the superstructure is nearly opposite to the phase of the ground motion. The second reason is that many bearing designs cannot avoid a special overlarge displacement due to motion instability and related sub-instability in the vibrational system.

Finally, another factor that renders prior art bearings less than optimal for use in bridge isolation is that bridge isolation may use a considerably shorter period than building isolation.

BRIEF SUMMARY OF THE INVENTION

Therefore, it is an object of the present invention to provide a seismic isolation bearing that is particularly suited for use in bridge isolation.

It is another object of the present invention to provide a seismic isolation bearing that is self-restoring under gravitational loading.

It is a further object of the present invention to provide a seismic isolation bearing with an effective means of frictional damping and wherein the frictional damping force can be selectively determined.

It is a further object of the present invention to provide a seismic isolation bearing with a locking mechanism that prevents relative displacement under normal non-seismic horizontal loading. Concerning this object of the present invention, it is a further goal to provide a locking mechanism that allows a limited range of relative displacement due to thermal expansion and contraction.

It is a further object of the present invention to provide a seismic isolation bearing with auxiliary damping to reduce bearing displacement and shorten the bearing period.

It is yet another object of the present invention to provide a seismic isolation bearing with guide means for maintaining rolling alignment of a roller situated between upper and lower plates of the bearing such that relative rolling motion between the roller and the plates occurs along a predetermined travel axis.

In view of these and other objects, a seismic isolation bearing is provided which comprises a lower plate, an upper plate, and a cylindrical roller in rolling contact with an upwardly facing bearing surface of the lower plate and a downwardly facing surface of the upper plate. The lower plate is fixable to a base, while the upper plate is fixable to a superstructure, for example a bridge deck. One or both bearing surfaces are sloped to form a central trough at which the cylindrical roller resides under normal weight of the superstructure, and toward which the roller is biased when relative displacement between the lower and upper plates occurs to provide a constant restoring force. A pair of sidewall members are fixed to the lower plate to withstand strong forces directed laterally with respect to the isolation axis along which rolling displacement occurs. In order to provide dry frictional damping, a pair of sliding guides are carried one at each end of the roller for engaging an inner wall surface of a corresponding sidewall member. Locking mechanisms disclosed include a plurality of bolts extending through tapped holes in the sidewall member for engaging the upper plate, as well as a pin and travel slot combination allowing limited relative displacement caused by thermal expansion and contraction to take place. Visco-elastic or viscous dampers, linear springs, and nonlinear springs such as hardening springs are preferably mounted between the lower and upper plates to reduce bearing displacement, dissipate energy, and otherwise adjust periodic motion characteristics exhibited by the bearing.

Another embodiment of the isolation bearing provides for both X and Y isolation by employing an intermediate plate between the upper and lower plates, a lower roller between the lower and intermediate plates for X axis isolation, and an upper roller between the intermediate and upper plates for Y axis isolation. This two layer isolation bearing allows for different restoring forces and different friction forces to be implemented with respect to the X and Y isolation axes, as dictated by design considerations.

Yet another embodiment of the present invention provides both X and Y isolation in a single layer design by employing a spherical roller between pyramid-like surfaces of a lower plate and/or an upper plate, wherein deformation of the spherical roller and rolling friction help to dissipate energy.

The present invention also encompasses a novel isolation bearing generally comprising a lower plate for attachment to a base structural member and an upper plate for attachment to a superstructure supported on the base. The lower plate has an upwardly facing bearing surface and the upper plate has a downwardly facing bearing surface, and a roller is situated between and in rolling contact with the bearing surfaces. The isolation bearing is characterized in that at least one of the bearing surfaces is a cylindrical surface that introduces linear lateral stiffness to the isolation bearing without the use of added linear spring elements. The other bearing surface preferably has a V-shaped profile and includes a damping insert in the crotch of the V to introduce nonlinear lateral stiffness to the bearing without the use of added nonlinear spring elements.

The present invention further encompasses an isolation bearing that generally comprises a lower plate for attachment to a base structural member and an upper plate for attachment to a superstructure supported on the base. The lower plate has an upwardly facing bearing surface and the upper plate has a downwardly facing bearing surface, and a roller is situated between and in rolling contact with the bearing surfaces. At least one of the bearing surfaces has a generally V-shaped profile characterized by a smoothly curved transition zone across an imaginary vertex of the V-shaped profile. Preferably, the transition zone is defined by a damping insert formed of rubber or synthetic visco elastic material fixed in the crotch of the V-shaped profile. This configuration introduces nonlinear lateral stiffness to the bearing without the use of added nonlinear spring elements. The other bearing surface may be flat, cylindrical, or have its own generally V-shaped profile. Use of a cylindrical surface introduces linear lateral stiffness to the isolation bearing without the use of added linear spring elements. Such an isolation bearing is disclosed and claimed in U.S. patent application Ser. No. 09/994,148, now abandoned, from which the present application claims benefit as a continuation-in-part.

The present invention extends to additional embodiments wherein either the upwardly facing bearing surface of the lower plate or the downwardly facing bearing surface of the upper plate has a generally V-shaped profile for self-restoring action of a roller in rolling contact with the bearing surfaces, and the isolation bearing further comprises guide means for maintaining the roller at a constant orientation relative to one, and preferably both, of the lower plate and the upper plate such that said roller, lower plate, and upper plate move relative to one another along a linear path or travel axis. In this way, misalignment during seismic excitation is prevented. In some guided roller embodiments described herein, the roller has an axis of rotation extending laterally with respect to the travel axis, the diameter of the roller is varied along the axis of rotation, and the lower and upper plates each having a lateral configuration complementary to that of the roller. In this way, vertical force on the roller from the supported load keeps the roller in proper rolling alignment relative to the plates. In other guided roller embodiments described herein, guidance is by engagement of laterally facing surfaces provided in opposing arrangement on the roller and the plates, whereby misalignment of the roller is countered by horizontal force. Still further guided roller embodiments comprise guide means wherein the angular motions at each opposite end of the roller are synchronized.

BRIEF DESCRIPTION OF THE SEVERAL VIEWS OF THE DRAWINGS

The nature and mode of operation of the present invention will now be more fully described in the following detailed description of the invention taken with the accompanying drawing figures, in which.

DETAILED DESCRIPTION OF THE INVENTION

Figure 1B:
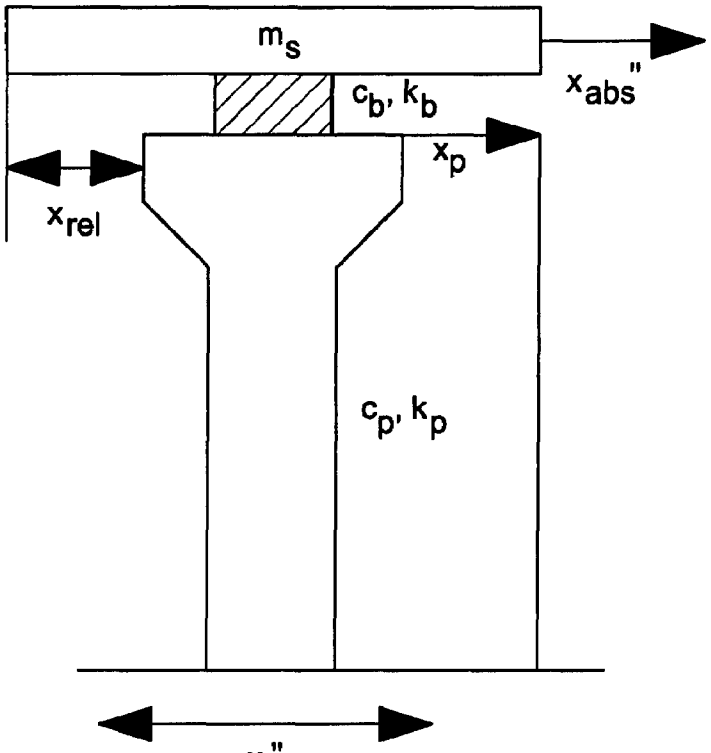
FIG. 1B PRIOR ART
FIG. 1B is a schematic view of a bridge isolation system according to prior art construction.
Figure 1A:
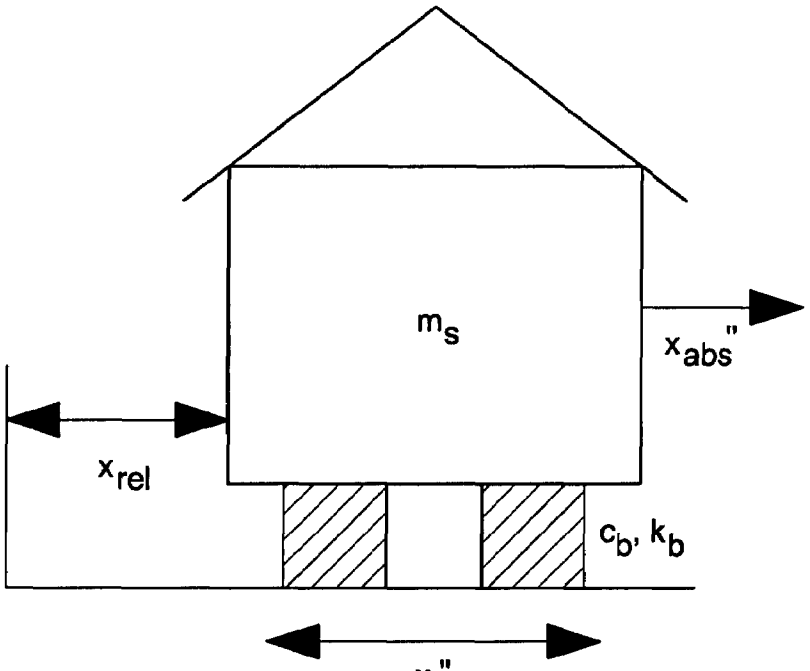
FIG. 1A PRIOR ART
FIG. 1A is a schematic view of a building isolation system according to prior art construction.
Figure 2:
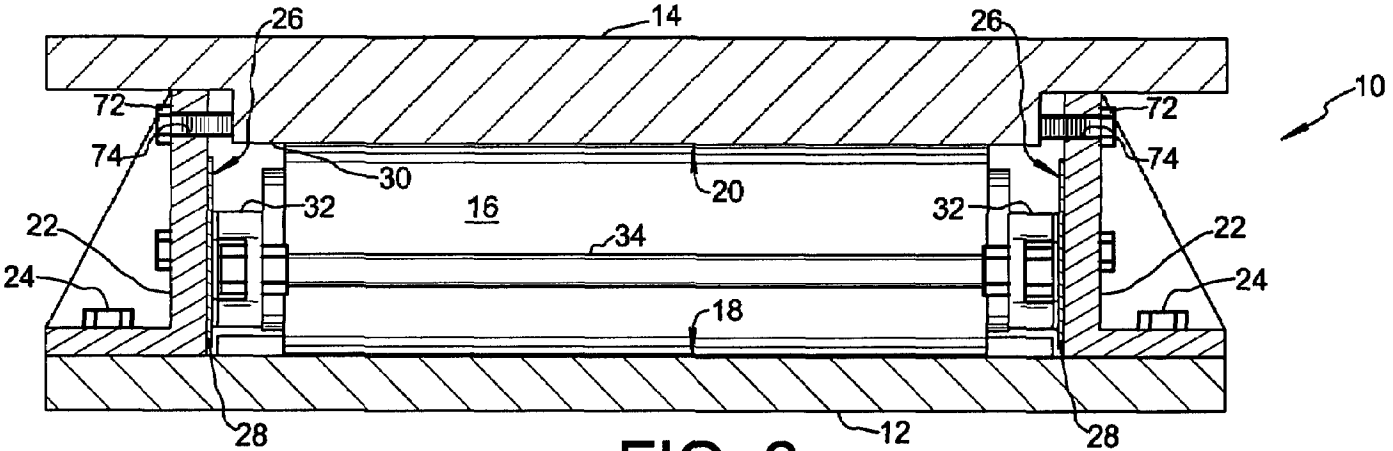
FIG. 2 is a front elevational view, partially sectioned, of an isolation bearing formed in accordance with a first embodiment of the present invention.
Figure 3:
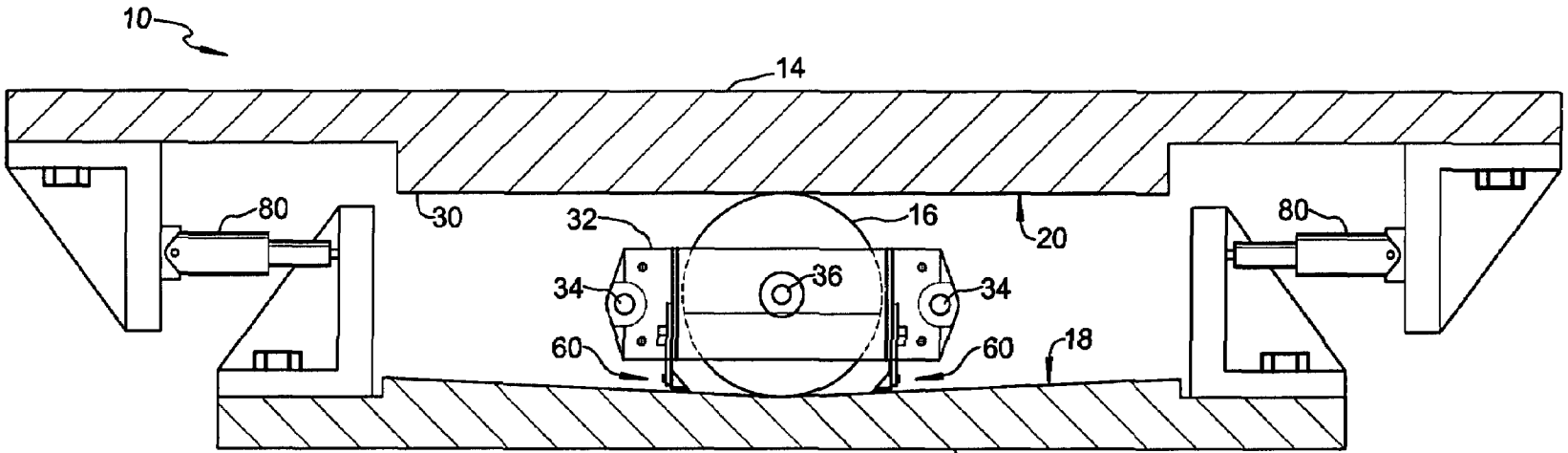
FIG. 3 is a side elevational view, partially sectioned, of the isolation bearing shown in FIG. 2.

Reference is directed now to FIGS. 2 and 3 of the drawings showing an isolation bearing 10 formed in accordance with a first embodiment of the present invention. Isolation bearing 10 comprises a lower plate 12 adapted for attachment to a base, an upper plate 14 adapted for attachment to a superstructure to be protected from seismic excitation, and a cylindrical roller 16 in rolling engagement with an upwardly facing bearing surface 18 of lower plate 12 and a downwardly facing bearing surface 20 of upper plate 14. Lower plate 12 and upper plate 14 are suitably adapted for respective attachment to the base and superstructure by providing a plurality of anchoring holes (not shown) vertically through each plate at locations near the periphery of the plate for the purpose of receiving cement anchors or other appropriate fasteners depending upon the specific environment in which bearing 10 is installed. Isolation bearing 10 of the first embodiment is primarily intended for use in a bridge isolation system similar to that shown in FIG. 1B, wherein the "base" to which lower plate 12 is attached is a bridge pier and the "superstructure" to which upper plate 14 is attached is the bridge deck.

Isolation bearing 10 is designed to allow relative displacement between lower plate 12 and upper plate 14 along an X isolation axis that runs normal to the page in FIG. 2 and extends horizontally across the page in FIG. 3. However, in order to withstand large horizontally directed "side loading" along a Y-axis orthogonal to the X isolation axis, a pair of right-angled sidewall members 22 are fixed to lower plate 12, preferably by threaded fasteners 24. The pair of sidewall members 22 are preferably designed and fixed to withstand a lateral load equal to or greater than the vertical load of the superstructure supported by isolation bearing 10, typically in the magnitude of hundreds of tons, to ensure that the sidewall members will not fail under extreme Y-axis side loading.

In accordance with the present invention, sidewall members 22 define a pair of opposing inner wall surfaces 26 that extend parallel to the X isolation axis of bearing 10. In the preferred embodiment shown in FIG. 2, sidewall members 22 include a friction track 28 removeably attached thereto, for example by countersunken screws (not shown) or the like, for defining opposing wall surfaces 26 in a manner that enables customizable control over the smoothness of wall surfaces 26. The importance of this feature will be discussed further herein.

As best seen in FIG. 3, upwardly facing bearing surface 18 has a generally V-shaped profile formed by two opposite surface portions sloping linearly downward toward one another. The slope of each surface portion is slight, on the order of two degrees from horizontal, but this slope angle is selectable depending upon system considerations. The sloped configuration of upwardly facing bearing surface 18 can be formed by milling an oversized flat plate of steel, or by cutting and fixing wedge portions to a flat plate of steel. The lowest point in the V-shaped profile is preferably centered with respect to lower plate 12.

Upper plate 14 is wider than lower plate 12 and includes an island 30 sized to fit between sidewall members 22, whereby downwardly facing bearing surface 20 is defined by island 30 and is arranged opposite to upwardly facing bearing surface 18. Island 30 can be formed by milling the periphery of a flat steel plate, or by fixing a smaller plate to a larger plate. In the embodiment now described, downwardly facing bearing surface 20 is flat for sake of simplicity. However, as will be appreciated from further description, it is not a necessity that downwardly facing bearing surface 20 be flat.

Figure 4:
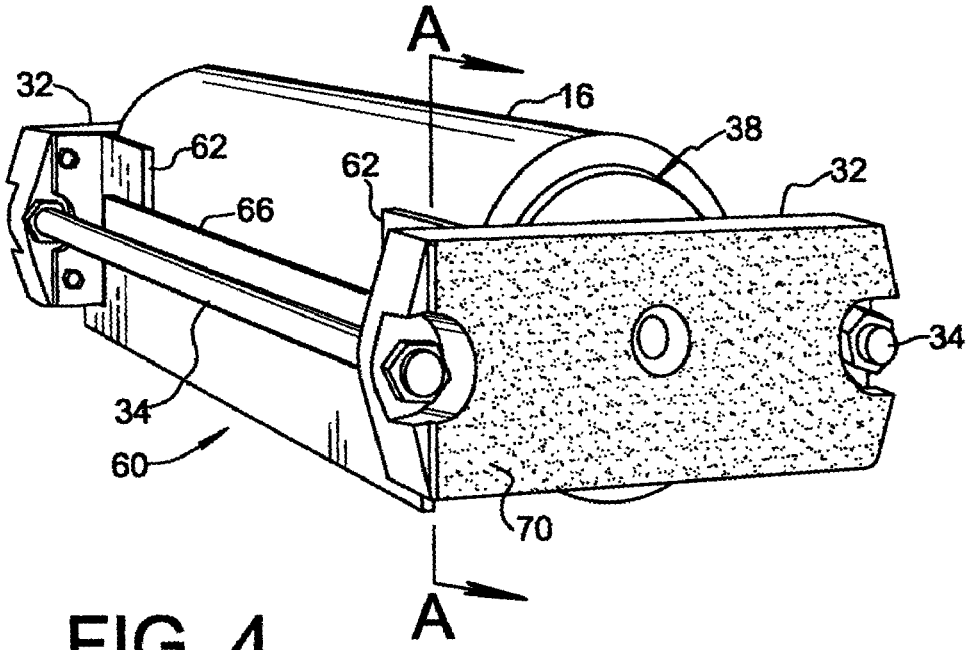
FIG. 4 is a perspective view of a roller assembly forming part of the isolation bearing shown in FIGS. 2 and 3.
Figure 5:
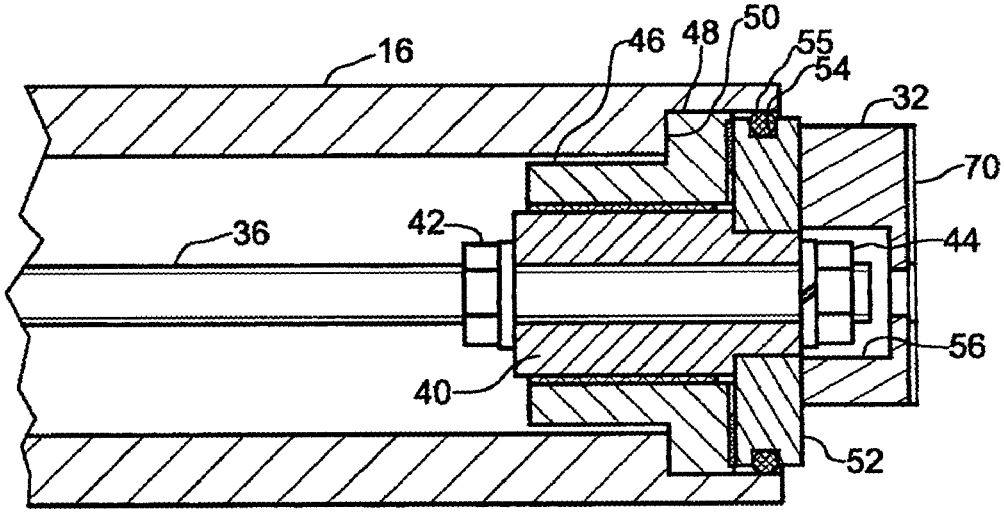
FIG. 5 is a partial cross-sectional view of the roller assembly shown in FIG. 4.

Cylindrical roller 16 in the present embodiment is preferably formed from steel tubing. As best seen in FIGS. 4 and 5, roller 16 is arranged such that its own axis of rotation is perpendicular to the X isolation axis of bearing 10, and a pair of sliding guides 32 are carried one at each opposite end of roller 16 for sliding engagement with inner wall surfaces 26. Sliding guides 32 are mounted on the ends of roller 16 by two non-axial journal shafts 34 and an axial journal shaft 36. More specifically, non-axial journal shafts 34 extend in front of and behind roller 16 parallel to the rotational axis of the roller, and the opposite ends of each non-axial journal shaft 34 are coupled to corresponding ends of sliding guides 32, whereby the sliding guides 32 and non-axial journal shafts 34 cooperate to form a rectangular frame about roller 16. Axial journal shaft 36 is provided for mounting end cap assemblies 38 on roller 16 in a manner that allows sliding guides 32 to be carried by, but not to rotate with, the ends of roller 16. Each end cap assembly 38 includes a shaft sleeve 40 mated onto axial journal shaft 36 and clamped between nuts 42 and 44, a bushing 46 arranged coaxially about shaft sleeve 40 and having a circumferential flange 48 for engaging a radial step 50 in the interior wall of tubular roller 16, and an end cap 52 fixed to an outer portion of shaft sleeve and having a circumferential groove 54 for seating an O-ring 55 against the interior wall of tubular roller 16. Clamping nut 44 is received in a counterbore 56 provided in sliding guide 32. Consequently, sliding guides 32 travel with roller 16, but do not rotate together with the roller.

Figure 6:
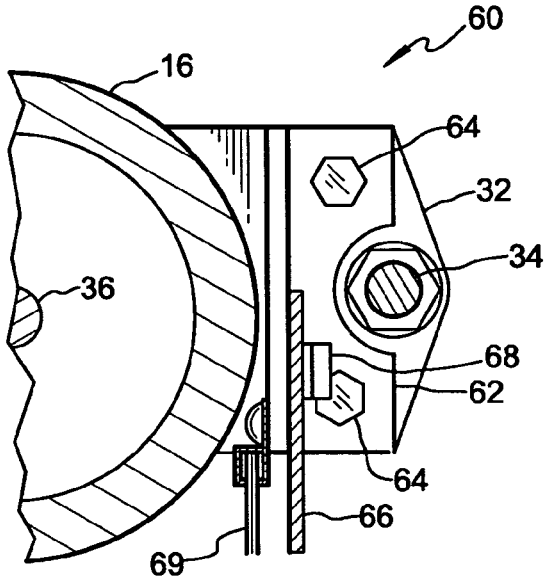
FIG. 6 is a cross-sectional view taken generally along the line A—A in FIG. 4.
Figure 7:
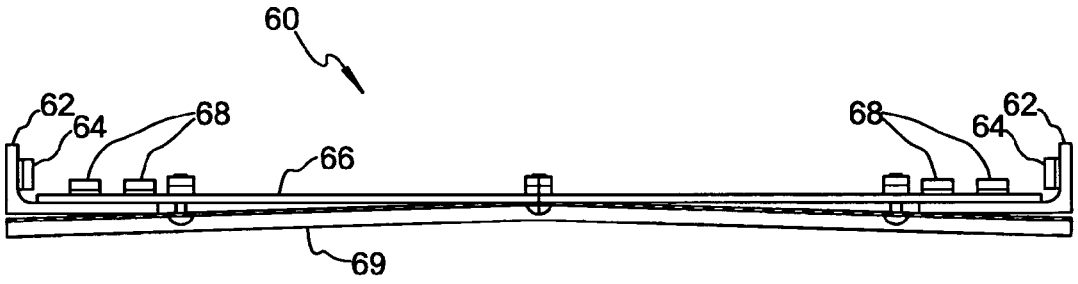
FIG. 7 is a top plan view of a sweeper attachment forming part of the roller assembly shown in FIG. 4.

In order to ensure that upwardly facing bearing surface 18 remains free of debris in the path of roller 16, a pair of sweeper assemblies 60 are mounted ahead of and behind the roller. A preferred sweeper assembly is shown in FIGS. 6 and 7. Each sweeper assembly 60 includes a pair of angle brackets 62 fixed by fasteners 64 to an inner surface of sliding guides 32 between roller 16 and a corresponding non-axial journal shaft 34. A fence plate 66 is mounted to angle brackets 62 by fasteners 68 to extend laterally parallel to the rotational axis of roller 16, and a sweeper brush 69 is attached to depend from fence plate 66 for sweeping the upwardly facing bearing surface 18 as roller 16 and sliding guides 32 move along the X isolation axis.

As can be understood from the description to this point, when vertical loading due to the weight of the supported superstructure is applied to bearing 10, roller 16 is biased to reside in a normal reference position as shown in FIG. 3 corresponding to a low point or trough location along the X isolation axis formed by the V-shaped configuration of upwardly facing bearing surface 18. This arrangement provides a constant restoring force when upper plate 14 is displaced relative to lower plate 12 under seismic excitation. In accordance with the present invention, movement of sliding guides 32 along the X isolation axis in sliding engagement with inner wall surfaces 26 provides a frictional damping force in combination with the gravitational restoring force inherent in the sloped bearing configuration, whereby energy is dissipated as heat. As mentioned above, sidewall members 22 preferably include a replaceable friction track 28 of selected smoothness for defining opposing wall surfaces 26. Likewise, sliding guides 32 preferably include a friction plate 70 replaceably attached to an outer surface thereof. By replacing friction tracks 28 and/or friction plates 70, the coefficient of friction between sliding guides 32 and wall surfaces 26 can be controlled to suit the system requirements for a particular installation environment.

A further aspect of the present invention results from mounting sidewall members 22 to lower plate 14 by threaded fasteners 24. After an earthquake, the sidewall members 22 can be disassembled from lower plate 12 if roller 16 is stuck in and trapped by the sidewall members. Once the sidewall members 22 are removed, no resistance except for small rotational friction is applied on the roller so that the roller will return to its center reference position by gravity.

In order to lock isolation bearing 10 against movement caused by relatively light horizontal loads encountered under normal conditions (i.e. wind, traffic, etc.), a plurality of bolts 72 are arranged to extend through threaded holes 74 in sidewall members 22 for engagement with upper plate 14. As can be understood from FIG. 2, bolts 72 provide a static frictional force to prevent relative motion between upper plate 14 and lower plate 12 along the X isolation axis of bearing 10 under normal non-seismic loading. Bolts 72 are tightened to provide a large static friction force that nevertheless is overcome during an earthquake. Advantageously, the magnitude of frictional resistance is variable by threaded adjustment of bolts 72 to adjust for expected normal loading.

As mentioned before, for bridge isolation it is desirable to reduce the bearing displacement by controlling the bearing sub-instability and the vibration phase difference. This is accomplished, as a feature of the present invention, by combining damping forces with gravitational restoring forces. As discussed above, frictional damping is provided through the use of sliding guides 32. Referring to FIG. 3, damping along the X isolation axis is also preferably provided by at least one damper unit 80 having one end connected to lower plate 12, such as through a sidewall member 22, and another end connected to upper plate 14. FIG. 3 shows a pair of damper units on opposite sides of the rotational axis of roller 16, however only one pair of damper units may be used or additional pairs of damper units may be provided in parallel on one or both sides of the rotational axis of roller 16. While damper units 80 are represented as a viscous or visco-elastic dampers in FIG. 3, it will be understood for sake of the present description that damper units 80 can also be linear springs or non-linear springs. In particular, numeric simulation indicates that the use of a hardening spring having an initial "dead zone" is beneficial in reducing bearing displacement. The use of a linear spring having an adjustable spring constant allows further control of the vibrational characteristics of isolation bearing 10. Visco-elastic and viscous dampers, linear springs including adjustable spring constant linear springs, and nonlinear springs including hardening springs, are all commercially available components.

Figure 15A:
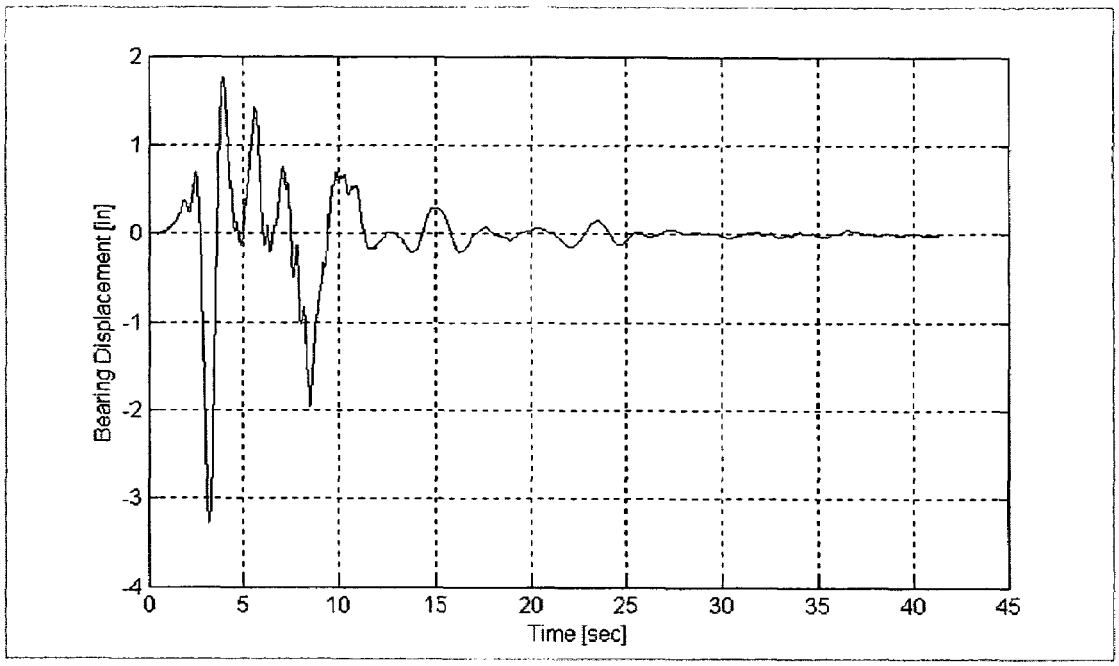
FIG. 15A PRIOR ART
FIG. 15A is a plot of displacement versus time for a conventional isolation bearing of the prior art as generated by numeric simulation of seismic excitation.
Figure 15B:
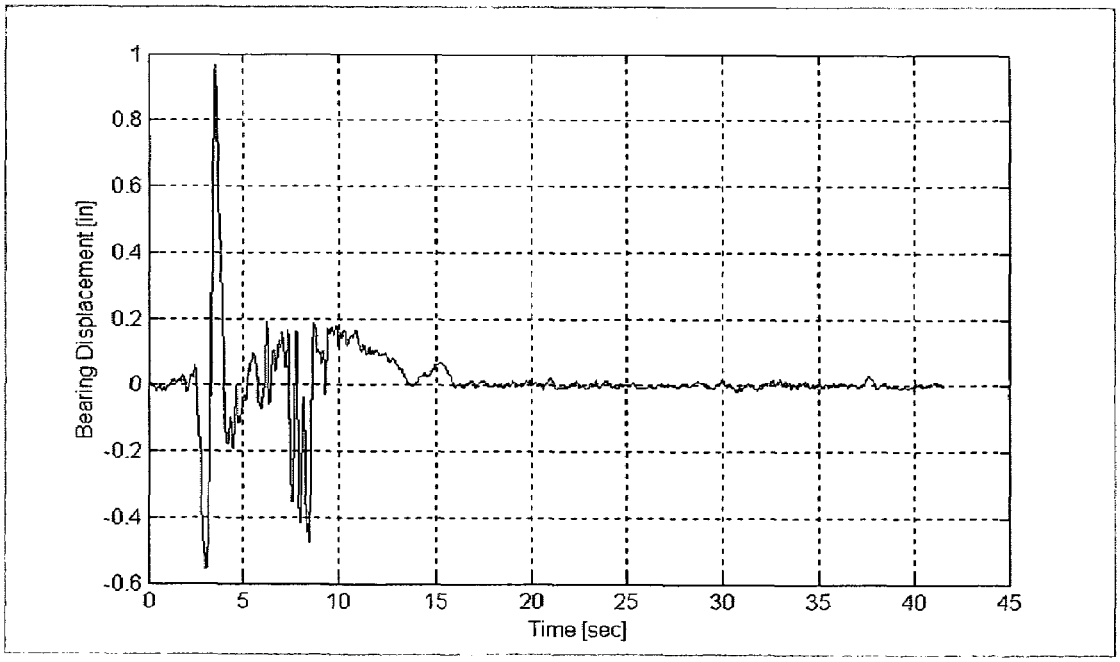
FIG. 15B is a plot similar to that of FIG. 15A, however for an isolation bearing of the present invention.

Attention is directed to FIGS. 15A and 15B of the drawings, for comparison of displacement characteristics of a conventional "Den Hartog's bearing" (a theoretical bearing model based on one or several single-degree-of-freedom linear vibrator(s)) as shown in FIG. 15A and those of a bearing formed in accordance with the present invention as shown in FIG. 15B. The plots are based on numerical simulation of bearing response to a seismic disturbance. The simulation was implemented using a computer software program developed with MATLAB® and SIMULNK® software tools. The bearing corresponding to FIG. 15B is chosen to have a frictional force of 127 tons, a restoring force of 4 tons, and a quadratic hardening spring having a dead zone of 0.0005 inches. The spring coefficient of 5000 tons per meter. The analysis indicates that the conventional Den Hartog's bearing has 55% damping and about a three-second period. Superstructure acceleration is reduced to be 0.09 g, and base shear is 1,530 Kips. The maximum bearing displacement is more than three inches. By contrast, the isolation bearing modeled according to the present invention had a maximum displacement of less than one inch. Thus, a more than three-fold reduction is achieved. The base shear is 1,690 Kips, which is slightly higher than that for Den Hartog's bearing, but still significantly lower than the base shear of 5420 Kips experienced without use of base isolation.

Figure 8:
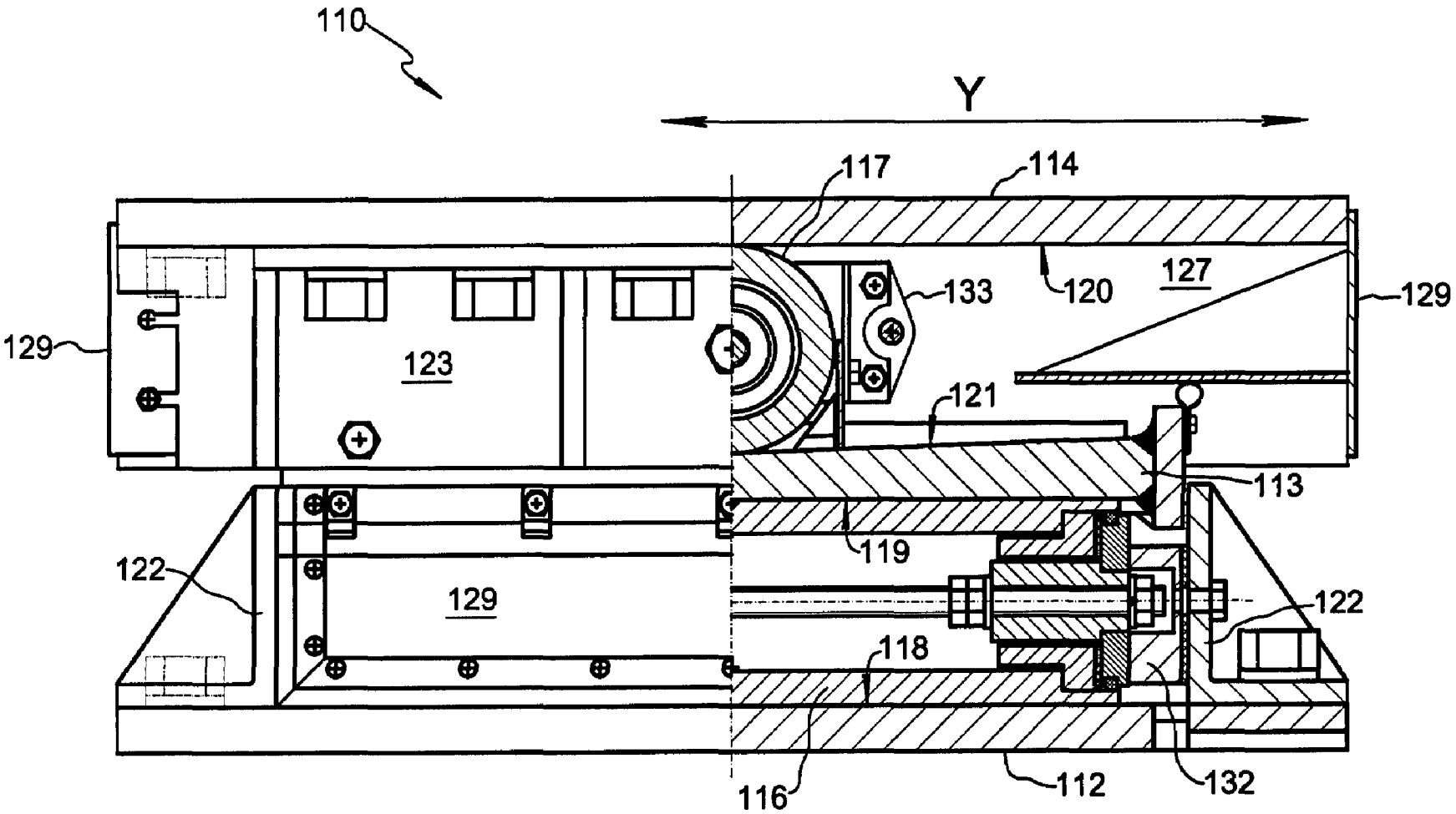
FIG. 8 is a front elevational view, partially sectioned, of an isolation bearing formed in accordance with a second embodiment of the present invention.
Figure 9:
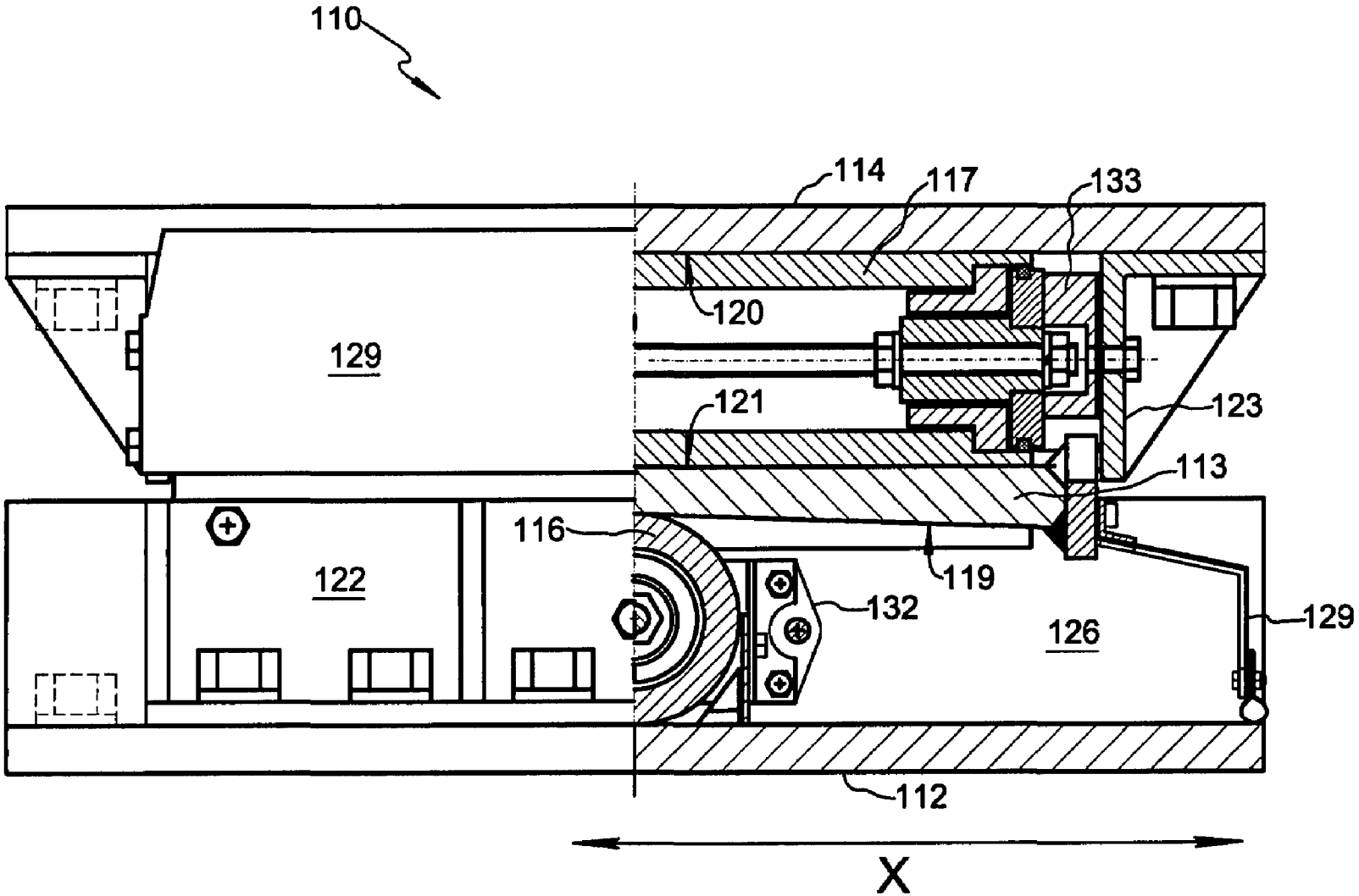
FIG. 9 is a side elevational view, partially sectioned, of the isolation bearing shown in FIG. 8.

An isolation bearing 110 formed in accordance with a second embodiment of the present invention is shown in FIGS. 8 and 9. Isolation bearing 110 is generally similar to isolation bearing 10 of the first embodiment, except that isolation bearing 110 provides isolation along orthogonal X and Y isolation axes. Isolation bearing 110 generally comprises a lower plate 112 adapted for attachment to a base, an intermediate plate 113, and an upper plate 114 adapted for attachment to a superstructure. A lower cylindrical roller 116 is positioned between, and in rolling contact with, an upwardly facing bearing surface 118 of lower plate 112 and a downwardly facing bearing surface 119 of intermediate plate 113 for accommodating relative displacement between the lower and intermediate plates along the X isolation axis. Likewise, an upper cylindrical roller 117 is provided between an upwardly facing bearing surface 121 of intermediate plate 113 and a downwardly facing bearing surface 120 of upper plate 114 for accommodating relative displacement between the intermediate and upper plates along the Y isolation axis.

In the second embodiment, sloped bearing surfaces for both X and Y isolation are provided on intermediate plate 113 for manufacturing efficiency and interchangeability of parts between the single axis bearing of the first embodiment and the double axis bearing of the second embodiment. Thus, downwardly facing bearing surface 119 has an inverted generally V-shaped profile, while upwardly facing bearing surface 121 has a generally V-shaped profile running in an orthogonal direction. Upwardly facing bearing surface 118 of lower plate 112 and downwardly facing bearing surface 120 of upper plate 114 are preferably flat for sake of simplicity. The bearing surfaces are thus configured to provide a normal reference position of lower roller 116 along the X isolation axis and a normal reference position of upper roller 117 along the Y isolation axis toward which the lower and upper rollers are respectively biased under gravitational loading.

Upstanding sidewall members 122 are fixed to lower plate 112, and downturned sidewall members 123 depend from upper plate 114. End covers 129 are provided to enclose the upper and lower layers of bearing 110 and prevent debris from entering the interior of the bearing. Lower roller 116 carries sliding guides 132 at its opposite ends for sliding contact with opposing inner surfaces 126 of the corresponding pair of sidewall members 122. In similar fashion, upper roller 117 carries sliding guides 133 at its opposite ends for sliding contact with opposing inner surfaces 127 of the corresponding pair of sidewall members 123. As a result, a frictional damping force is produced along both the X and Y isolation axes.

As mentioned above, certain factors inherent in the structural environment for which the isolation bearing is designed may dictate that different isolation characteristics be present with respect to the X isolation axis as compared with the Y isolation axis. One way this is achieved in isolation bearing 110 of the second embodiment is by providing a different frictional force associated with sliding guides 132 than that associated with sliding guides 133, for example by specifying different friction tracks and friction plates to attain different coefficients of friction for the X and Y isolation axes. Another way this is achieved in isolation bearing 110 is by providing different restoring forces along the X and Y isolation axes through the use of different slope angles for downwardly facing bearing surface 119 and upwardly facing bearing surface 121. This approach offers means for limiting peak bearing displacement, which is substantially inversely proportional to the slope angle.

Damper units (not shown in FIGS. 8 and 9) of different types can be installed between lower plate 112 and intermediate plate 113 to act along (parallel to or coincident with) the X isolation axis, and between intermediate plate 113 and upper plate 114 to act along (parallel to or coincident with) the Y isolation axis. In this regard, reference is made to the description of damper units 80 used in connection with isolation bearing 10 of the first embodiment.

Figure 12:
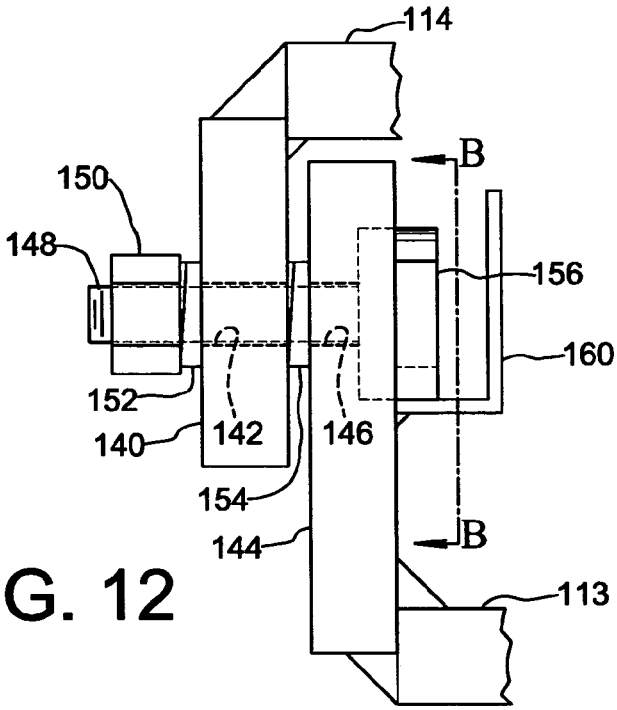
FIG. 12 is a view showing an alternative locking mechanism for use in an isolation bearing of the present invention.
Figure 13:
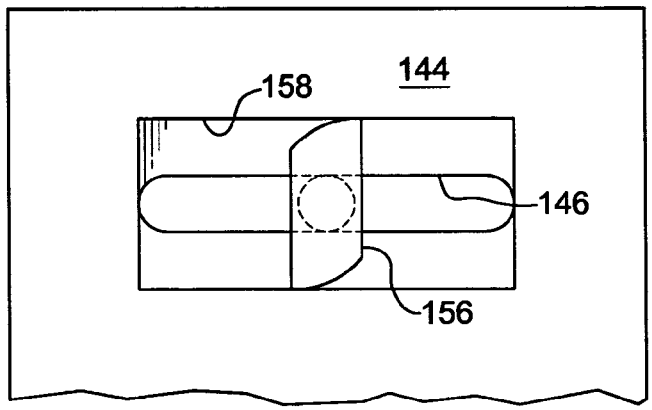
FIG. 13 is a view taken generally along the line B—B in FIG. 12.

FIGS. 12 and 13 depict a locking mechanism useful in either isolation bearing 10 of the first embodiment or isolation bearing 110 of the second embodiment as an alternative to bolts 72 described above in connection with isolation bearing 10. In the context of the Y isolation axis of isolation bearing 110, the locking mechanism comprises a first member 140 fixed relative to upper plate 114 and having a pin hole 142 therethrough, a second member 144 fixed relative to intermediate plate 113 and having a travel slot 146 that extends parallel to the Y isolation axis and which proximately overlaps with pin hole 142, and a locking pin 148 extending through pin hole 142 and travel slot 146. A nut 150 threaded on the end of locking pin 148, a spring washer 152 between nut 150 and first member 140, and another spring washer 154 between first member 140 and second member 144 act to maintain axial tension in locking pin 148 to provide a frictional locking force. As best seen in FIG. 13, locking pin 148 includes a specially formed elongated head 156 configured to fit through travel slot 146 when head 156 is orientated horizontally. Head 156 resides within a rectangular recess 158 in second member 144 which confines locking pin 148 against loosening rotation when axial tension is applied, and permits tightening of bolt 150. In order not to completely lock members 140 and 144 due to possible corrosion, anti-corrosive materials are preferably used. The locking mechanism of FIGS. 12 and 13 allows movement within the range of travel slot 146 when a large static force is applied, such as that generated by thermal expansion. However, when an earthquake of sufficient strength occurs, locking pin 148 is broken to allow the bearing to perform in its intended manner. When locking pin 148 is broken, nut 150 and the connected portion of pin 148 will fall down outside the bearing, while the remaining portion of the locking pin including head 156 will fall into a small receptacle 160 mounted on second member 144 to prevent the pin portion from falling onto a bearing surface. After the earthquake, the inner portion of locking pin 148 can easily be removed from receptacle 160 and a new locking pin can be installed.

Figure 14:
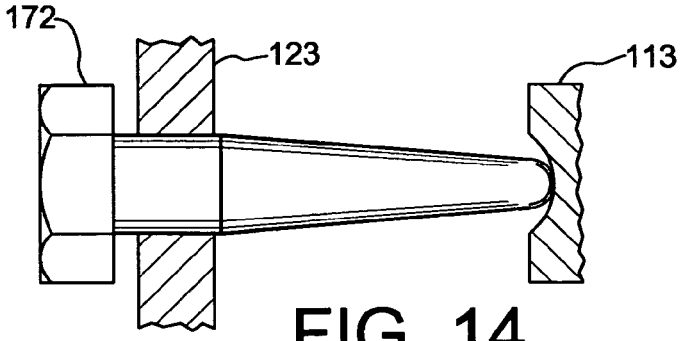
FIG. 14 is a view showing another alternative locking mechanism for use in an isolation bearing of the present invention.

FIG. 14 shows another alternative locking mechanism useful in either isolation bearing 10 of the first embodiment or isolation bearing 110 of the second embodiment as an alternative to bolts 72 described above in connection with isolation bearing 10. The locking mechanism of FIG. 14 is a modified bolt 172 similar to bolts 72 described previously, however modified bolt 172 is tapered along its length and rounded at its engagement end to act as a deformable cantilevered beam allowing small bearing displacements. Modified bolt 172 will break under larger seismic loading to allow the bearing to work as designed.

Figure 10:
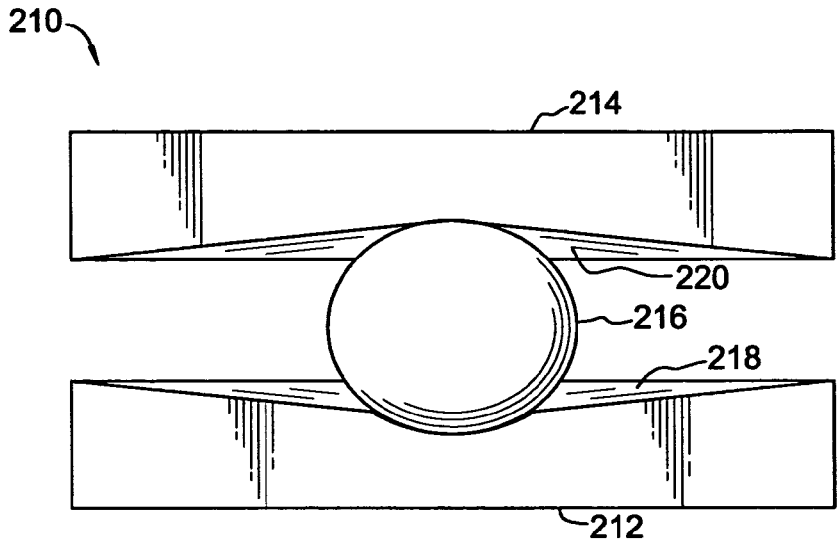
FIG. 10 is a conceptual side elevational view of an isolation bearing formed in accordance with a third embodiment of the present invention.
Figure 11:
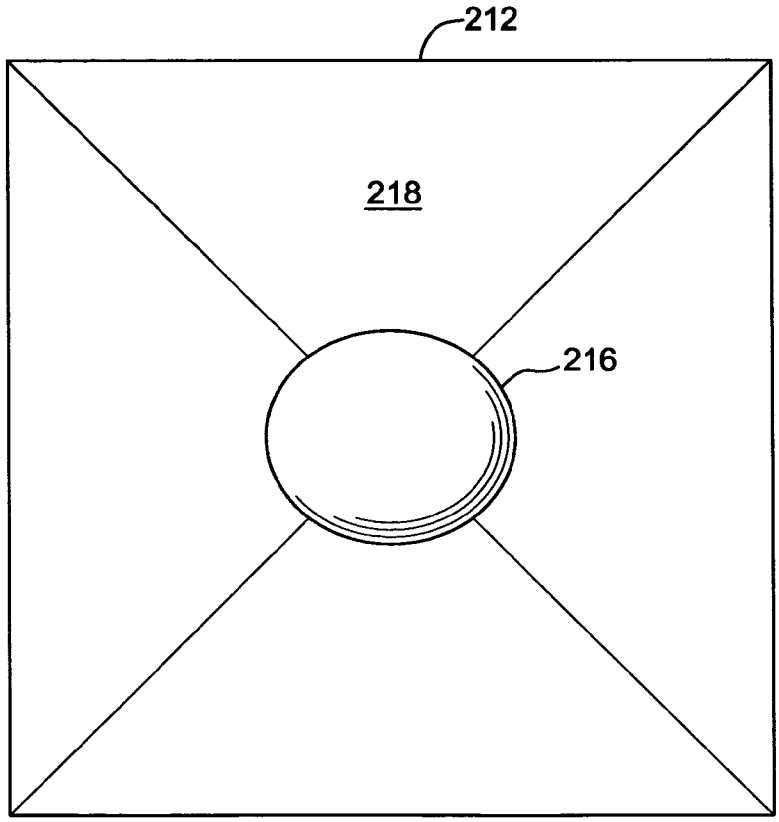
FIG. 11 is a conceptual top plan view of the isolation bearing shown in FIG. 10, with its top plate removed.

FIGS. 10 and 11 conceptually show an isolation bearing 210 in accordance with a third embodiment of the present invention. Isolation bearing 210 provides restorative force under gravitational loading along both X and Y isolation axes without the need for two separate rollers and two layers as in isolation bearing 110. More specifically, isolation bearing 210 includes a lower plate 212 adapted for attachment to a base and having an upwardly facing bearing surface 218, an upper plate 214 adapted for attachment to a superstructure and having a downwardly facing bearing surface 220, and a generally spherical roller 216 between the upper and lower plates in rolling contact with bearing surfaces 218 and 220. One or both of bearing surfaces 218 and 220 are configured in a pyramid-like form so as to define four surface portions that all slope toward a common location to define a reference position for spherical roller 216. Looking at FIG. 11, upwardly facing bearing surface 218 includes four surface portions 218A, 218B, 218C, and 218D gently sloped toward a central point. Spherical roller 216 is preferably deformable to provide energy dissipation similar to visco-elastic damping when relative velocity occurs, and to reduce vertical accelerations. Dry friction damping will be created as spherical roller 216 rolls in between bearing surfaces 218 and 220. Friction material is preferably used to increase the dry friction forces. Features discussed above in connection with the first and second embodiments, including the various locking mechanisms and use of linear springs, hardening springs, and mounted damper units, are also applicable to the third embodiment.

Figure 16:
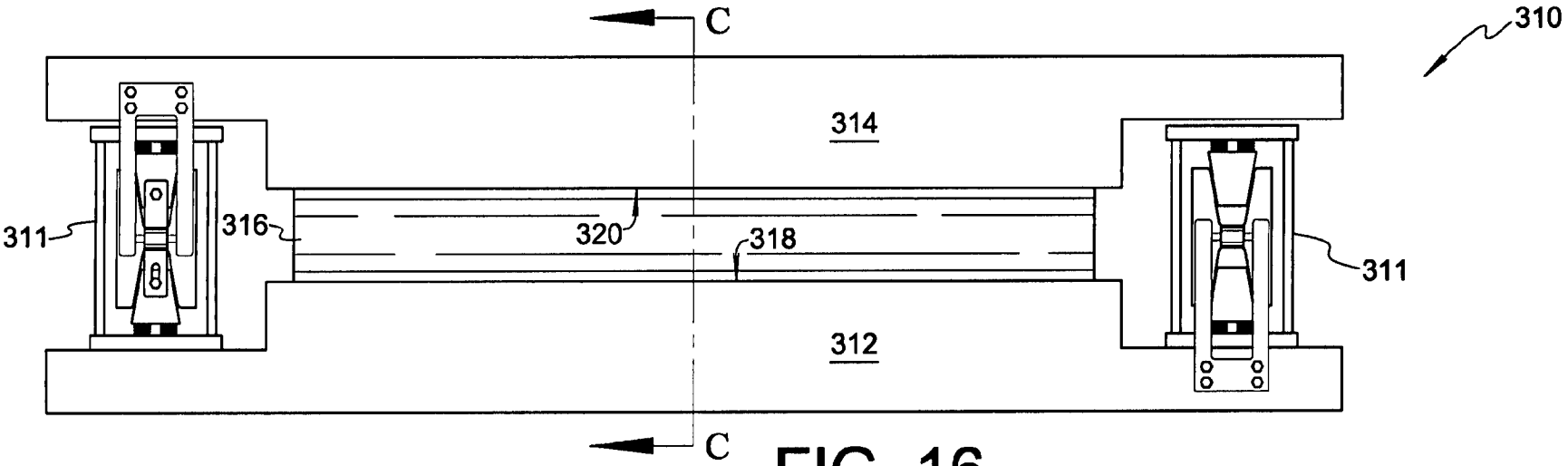
FIG. 16 is a simplified elevational view of an isolation bearing formed in accordance with a further aspect of the present invention.
Figure 17:
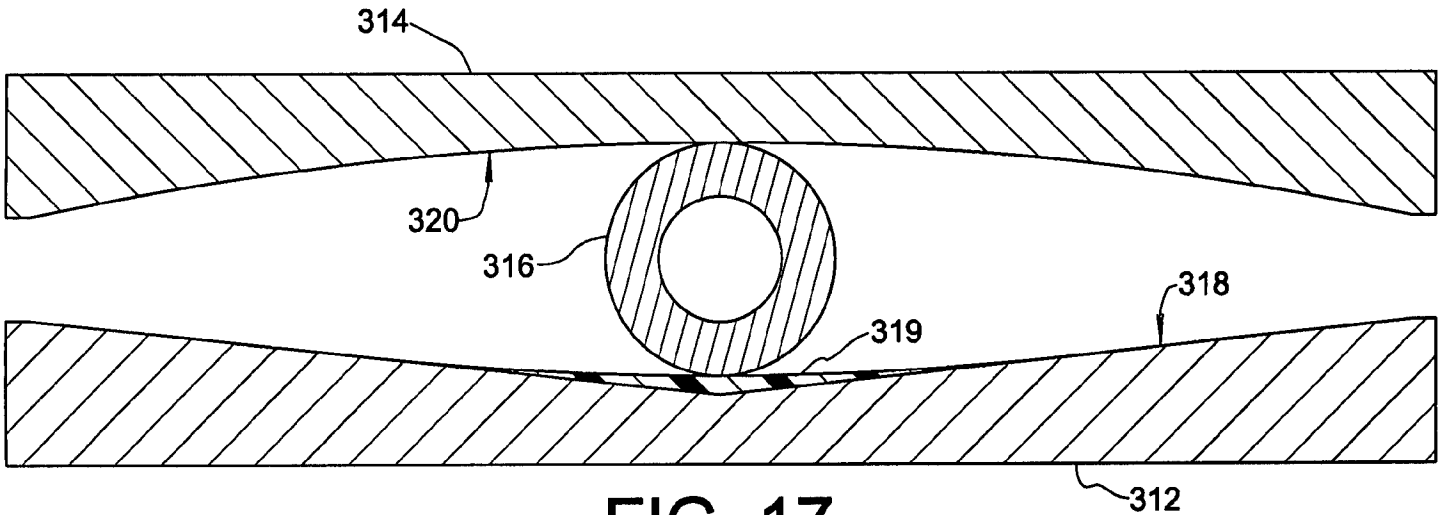
FIG. 17 is a simplified cross-sectional view of taken generally along the line C—C in FIG. 16.

Attention is now directed to FIGS. 16 and 17, which show an isolation bearing 310 incorporating friction dampers 311 (FIG. 16 only) and being formed in accordance with a further aspect of the present invention. Isolation bearing 310 comprises a lower plate 312 adapted for attachment to a base, an upper plate 314 adapted for attachment to a superstructure, and a roller 316 between plates 312 and 314. As best seen in FIG. 17, lower plate 312 includes an upwardly facing bearing surface 318 having a gradually sloped V-shaped profile, while upper plate 314 includes a downwardly facing bearing surface 320 in the form of a cylindrical surface. Bearing surfaces 318 and 320 are in rolling contact with roller 316, which in the present embodiment is configured as a cylindrical roller. It is noted that the bearing surfaces could be switched one for the other, namely upwardly facing bearing surface 318 could be a cylindrical surface and downwardly facing bearing surface 320 could have a V-shaped profile. The V-shaped profile causes isolation bearing 310 to be self-centering in a manner described in related U.S. patent application Ser. No. 09/994,148. Use of a cylindrical bearing surface provides an effect equivalent to that of a linear spring by introducing linear lateral stiffness. It is preferred that the cylindrical surface have a gradual curvature that is "flattened" with respect to the vertical direction, however a circular arc profile will typically be less expensive to manufacture. For example, the cylindrical surface preferably has a profile described by the equation $(x-h)^2+(y-k)^\beta=r^2$, where $\beta<=2$, and h and k are respectively the x and y coordinates of the center of curvature. For performance reasons, it may be preferable that the profile be confined to a condition where exponent $\beta$ is less than 2, whereas for manufacturing economy, it may be preferable that the profile be confined to a condition where exponent $\beta$ is equal to 2.

In accordance with the present invention, generally V-shaped bearing surface 318 is characterized by a smoothly curved transition zone across an imaginary vertex thereof. The curved transition zone is preferably provided by a damping insert 319 formed of a suitable damping material, such as rubber or synthetic viscoelastic material, and fixed at a crotch of the V-shaped profile of upwardly facing bearing surface 318. This feature provides an effect equivalent to that of a non-linear spring introducing non-linear lateral stiffness. The radius of curvature of the damping insert's profile is chosen to be slightly large than the radius of roller 316, thereby introducing further non-linear stiffness to the system. Alternatively, the bearing surface itself could be machined to provided the smoothly curved transition zone.

Isolation bearing 310 compares favorably to a conventional friction pendulum bearing, in that it is able to provide the same long oscillation period in a smaller sized bearing. Generally speaking, better acceleration reduction is achieved with a longer period.

Figure 18:
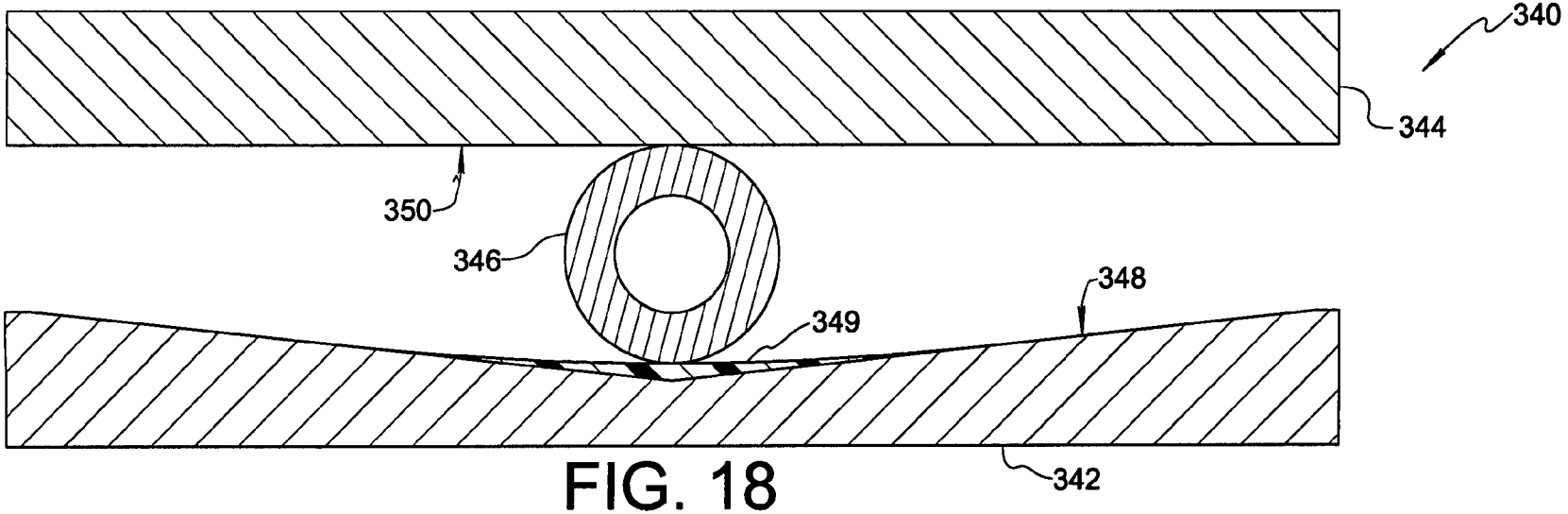
FIG. 18 is a view similar to that of FIG. 17, however showing an alternative bearing surface configuration.
Figure 19:
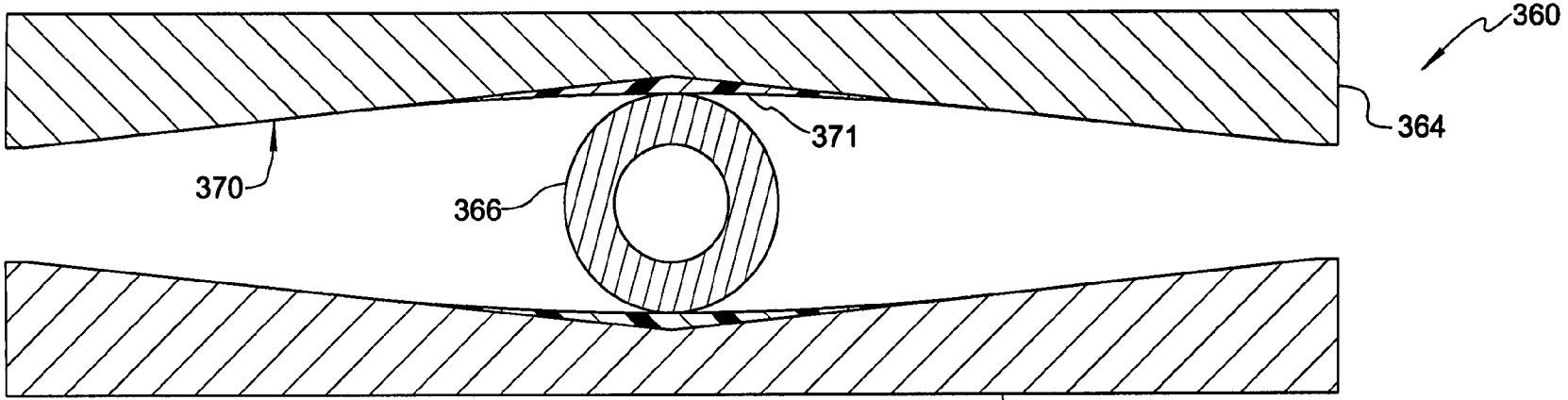
FIG. 19 is a view similar to that of FIG. 17, showing a further alternative bearing surface configuration.

FIGS. 18 and 19 depict other isolation bearing configurations of the present invention. FIG. 18 shows an isolation bearing 340 that has a lower plate 342 similar to that of isolation bearing 310 of FIGS. 16 and 17, and an upper plate 344 having a downwardly facing bearing surface 350 that is planar. Alternatively, lower plate 342 and upper plate 344 could be switched for one another. FIG. 19 shows an isolation bearing 360 that has a lower plate 362 similar to that of isolation bearing 310 of FIGS. 16 and 17, and an upper plate 364 having a downwardly facing bearing surface 370 of generally inverted V-shaped profile in rolling contact with roller 366. A corresponding damping insert 371 defining a smoothly curved transition zone is preferably provided in similar but inverted fashion.

Referring to FIG. 18, when such an isolation bearing is used to protect large objects such as supercomputers from the effects of seismic energy, it is preferred that the entire bearing surfaces 348 and/or 350 be coated with a layer of the damping material such as the material that formed damping insert 349. Alternatively the outer surface of roller 346 may be coated with a layer of damping material, with or without the layer of damping material on bearing surfaces 348 and/or 350. The purpose of such layers of damping material is to eliminate or reduce vibrations generated in the system.

Attention is now directed to FIGS. 20–35, which depict various seismic isolation bearings of a general type comprising a lower plate having an upwardly facing bearing surface, an upper plate having a downwardly facing bearing surface, and a roller situated between the plates in rolling contact with the respective bearing surfaces, wherein one of the bearing surfaces has a generally V-shaped profile. In accordance with another aspect of the present invention, the problem of guiding the roller with respect to one or preferably both of the plates is solved by various guidance means as described herein. Although the guidance means are described in relation to a basic isolation bearing system acting along a single travel axis, it will be realized by those of ordinary skill in the art that the disclosed guidance means can be implemented at each layer of a multilayer system wherein each layer acts along a different travel axis. For example, in a two-layer isolation bearing acting along orthogonal X and Y travel axes, guidance means can be provided for maintaining alignment of a first roller with respect to a lower and middle plate between which the first roller is situated, and further guidance means can be provided for maintaining alignment of a second roller with respect to the middle plate and an upper plate between which the second roller is situated. Accordingly, the terms "upper plate" and "lower plate" refer to the relationship of the plate relative to a roller, as opposed to the location of the plate in the overall bearing assembly.

Figure 20:
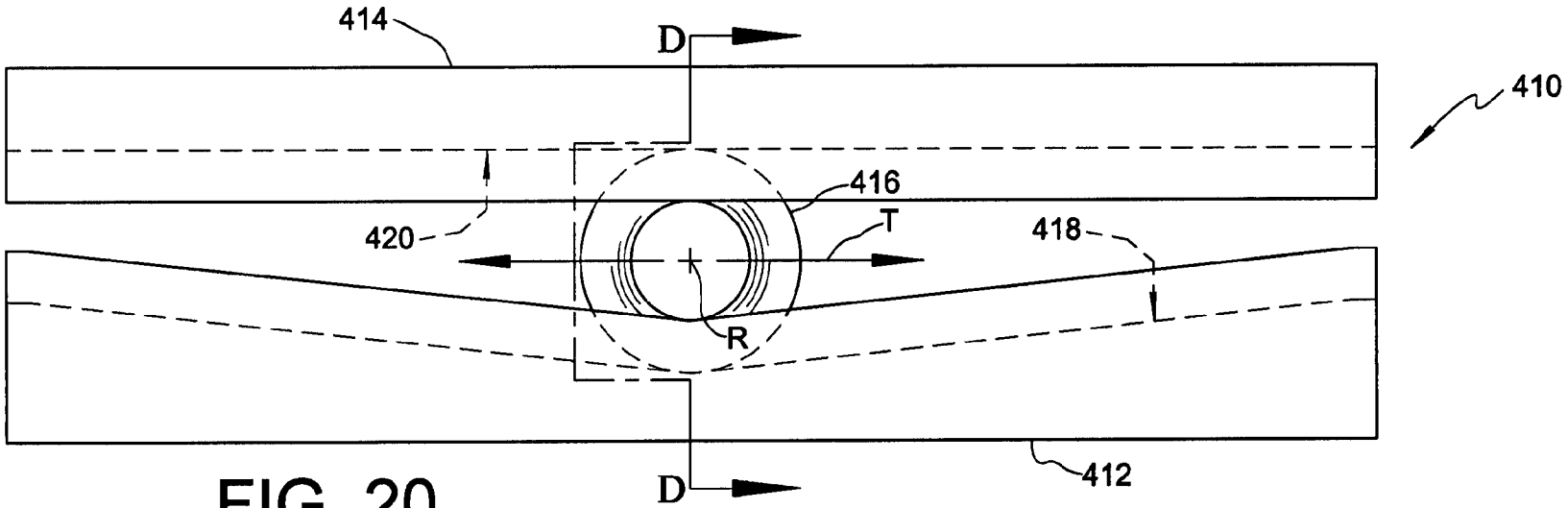
FIG. 20 is a side elevational view showing an isolation bearing of the present invention having a guide means for the roller according to a first guided roller embodiment.
Figure 21:
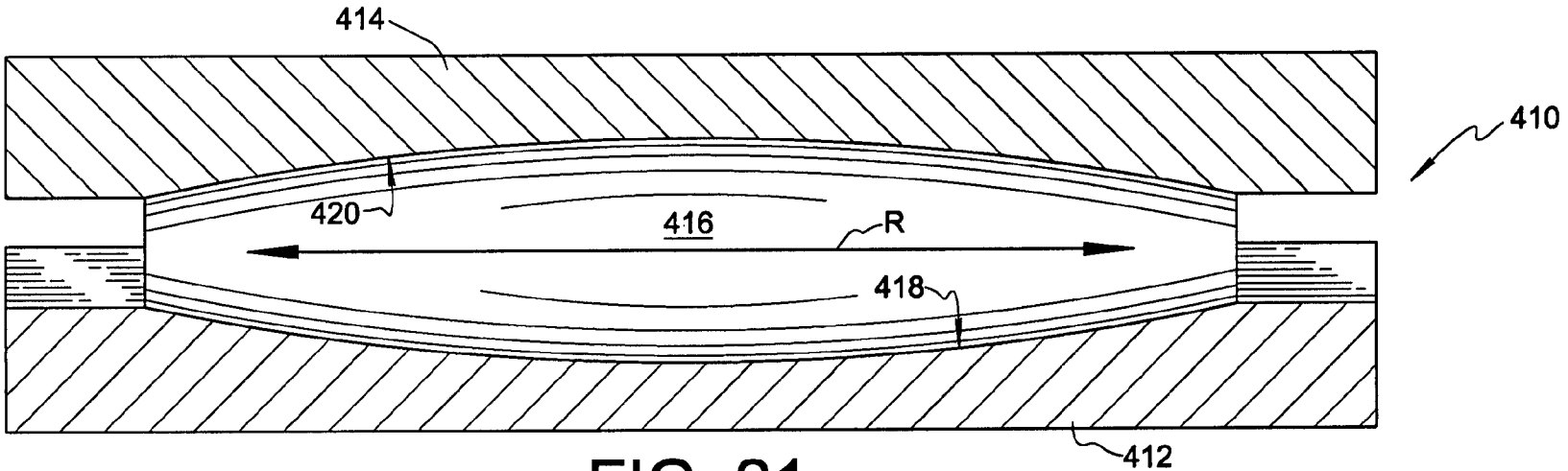
FIG. 21 is a cross-sectional view taken generally along the line D—D in FIG. 20.

FIGS. 20 and 21 show an isolation bearing 410 comprising a lower plate 412 having an upwardly facing bearing surface 418 of V-shaped profile, an upper plate 414 having a downwardly facing bearing surface 420 that is flat in profile, and a roller 416 situated between and in rolling with bearing surfaces 418 and 420. Isolation bearing 410 is designed to accommodate relative motion between lower plate 412 and upper plate 414 along a travel axis T by virtue of the rolling motion of roller 416 along the same travel axis T common to the lower and upper plates. Accordingly, roller 416 has a rotational axis R extending laterally relative to travel axis T. As best seen in FIG. 21, the diameter of roller 416 changes along rotational axis R, specifically in a continuous curve, and lower plate 412 and upper plate 414 each have a lateral configuration complementary to that of roller 416. As will be understood, any tendency of roller 416 to rotate about an imaginary vertical axis relative to either plate 412 or 414 and thereby become misaligned will require work against the vertical normal force of the structural load supported by the bearing 410. Thus, roller 416 is biased to remain in an aligned state by the vertical force of the supported load.

Figure 22:
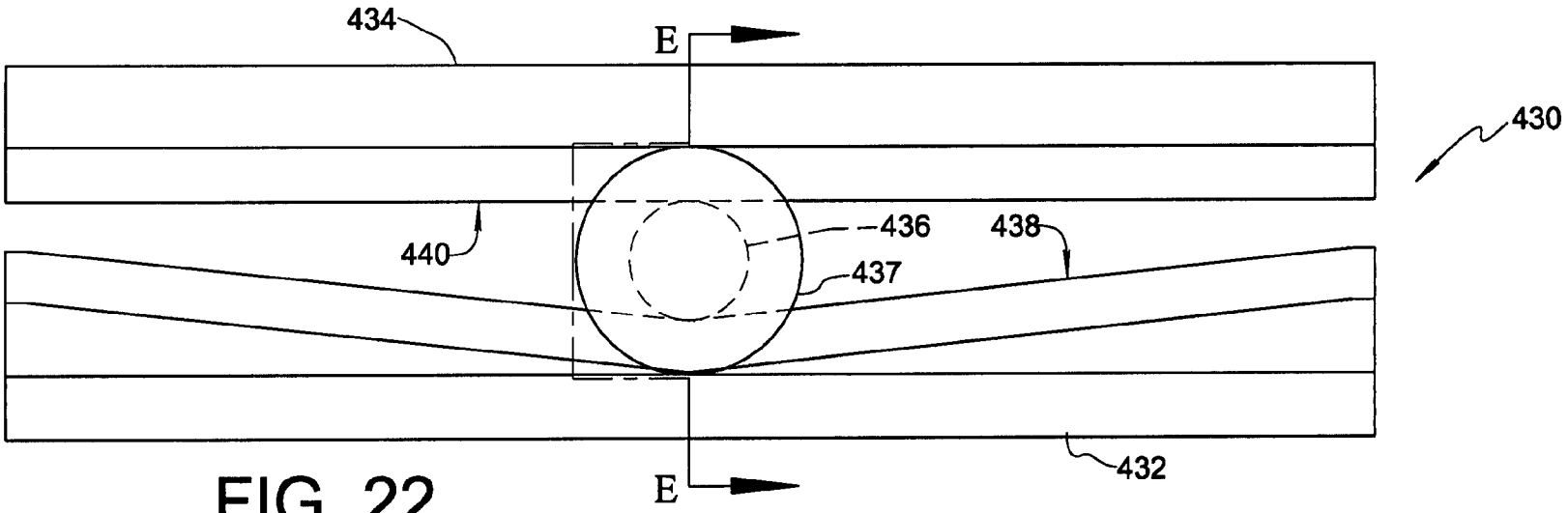
FIG. 22 is a side elevational view showing an isolation bearing of the present invention having a guide means for the roller according to a second guided roller embodiment.
Figure 23:
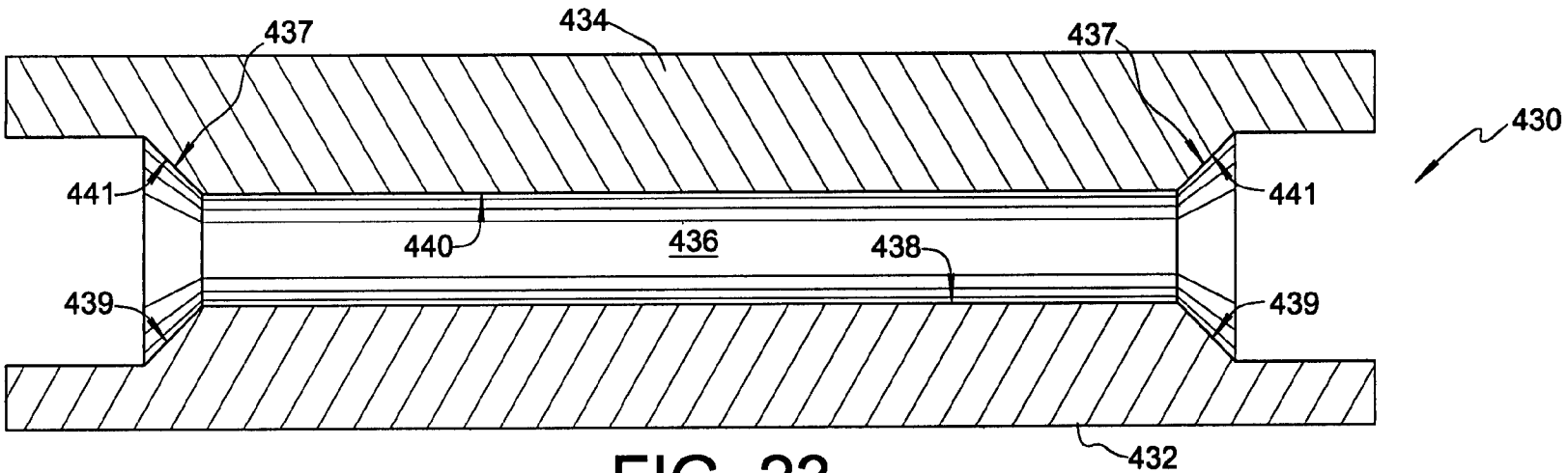
FIG. 23 is a cross-sectional view taken generally along the line E—E in FIG. 22.
Figure 24:
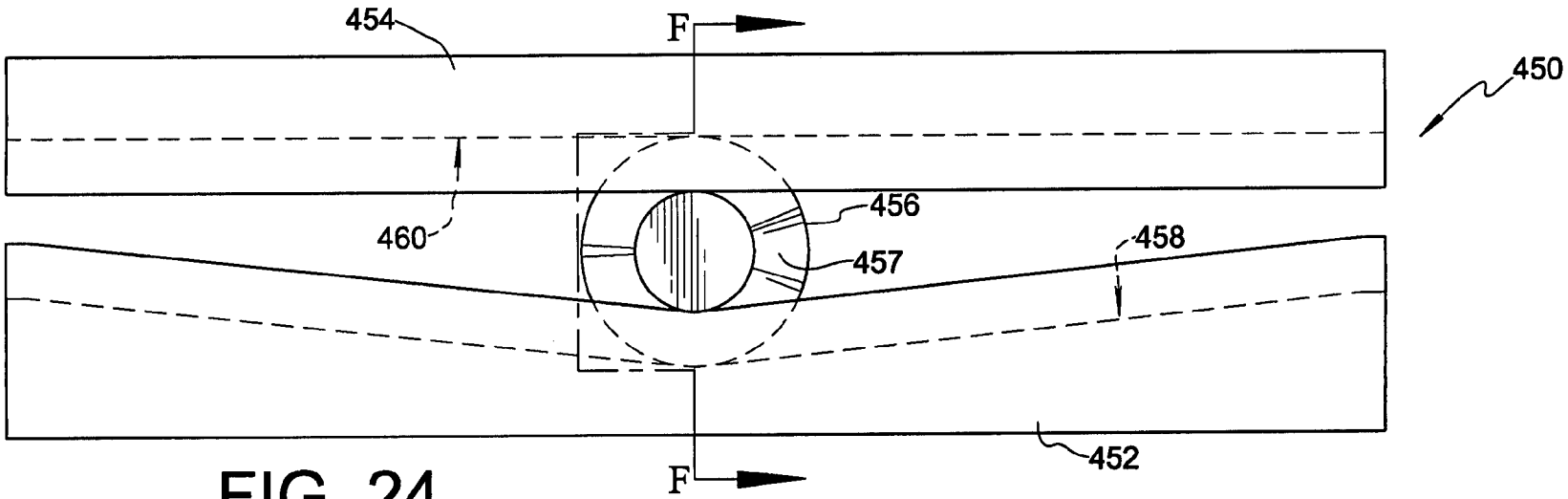
FIG. 24 is a side elevational view showing an isolation bearing of the present invention having a guide means for the roller according to a third guided roller embodiment.
Figure 25:
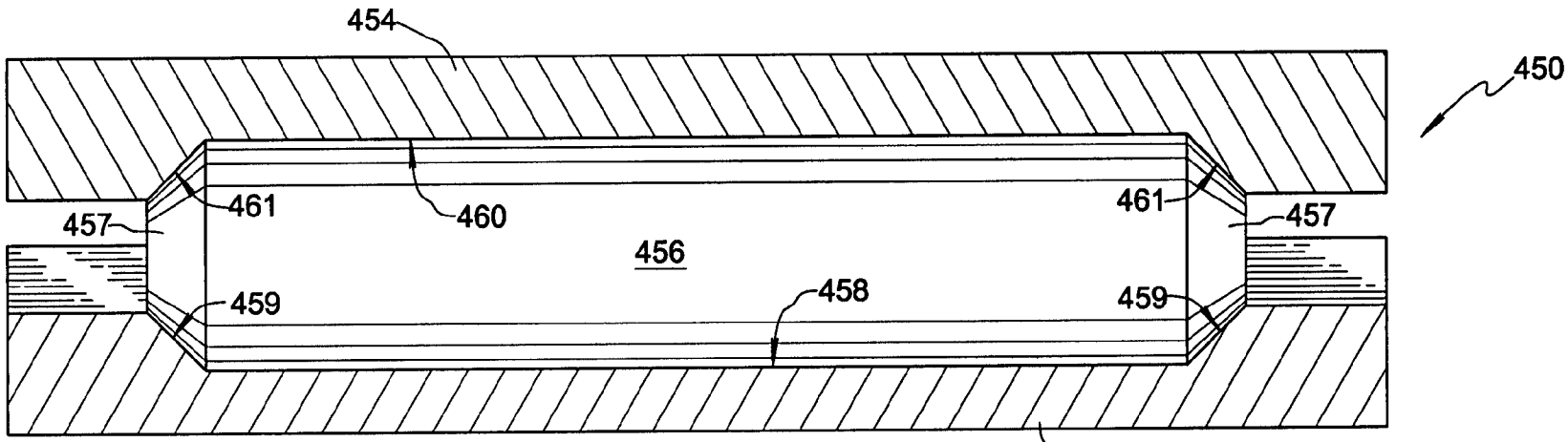
FIG. 25 is a cross-sectional view taken generally along the line F—F in FIG. 24.

FIGS. 22 and 23 show and isolation bearing 430 comprising a lower plate 432 having an upwardly facing bearing surface 438 of V-shaped profile, an upper plate 434 having a downwardly facing bearing surface 440 that is flat in profile, and a roller 436 in rolling contact with bearing surfaces 438 and 440. As seen in FIG. 23, roller 436 has a lateral configuration defined by a cylindrical portion located between a pair of opposite frusto-conical portions 437 tapered toward the middle cylindrical portion. The surface of each frusto-conical portion 437 rolls along guide surfaces 439 and 441 respectively provided on lower plate 432 and upper plate 434 at an incline complementary to the frusto-conical incline. As will be appreciated, roller 436 is confined against misalignment, particularly when a load is supported by bearing 430. FIGS. 24 and 25 depict an embodiment similar to that of FIGS. 22 and 23. In the embodiment of FIGS. 24 and 25, a seismic isolation bearing 450 comprises a lower plate 452 including a V-shaped bearing surface 458, and upper plate 454 including a flat bearing surface 460, and a roller 456 having a lateral configuration defined by a cylindrical portion located between a pair of opposite frusto-conical portions 457 tapered away from the middle cylindrical portion (each portion 457 could theoretically be tapered to a point to form a conical portion as opposed to a frusto-conical portion). The surface of each frusto-conical portion 457 rolls along respective guide surfaces 459 and 461 formed at an incline complementary to the frusto-conical incline.

Figure 26:
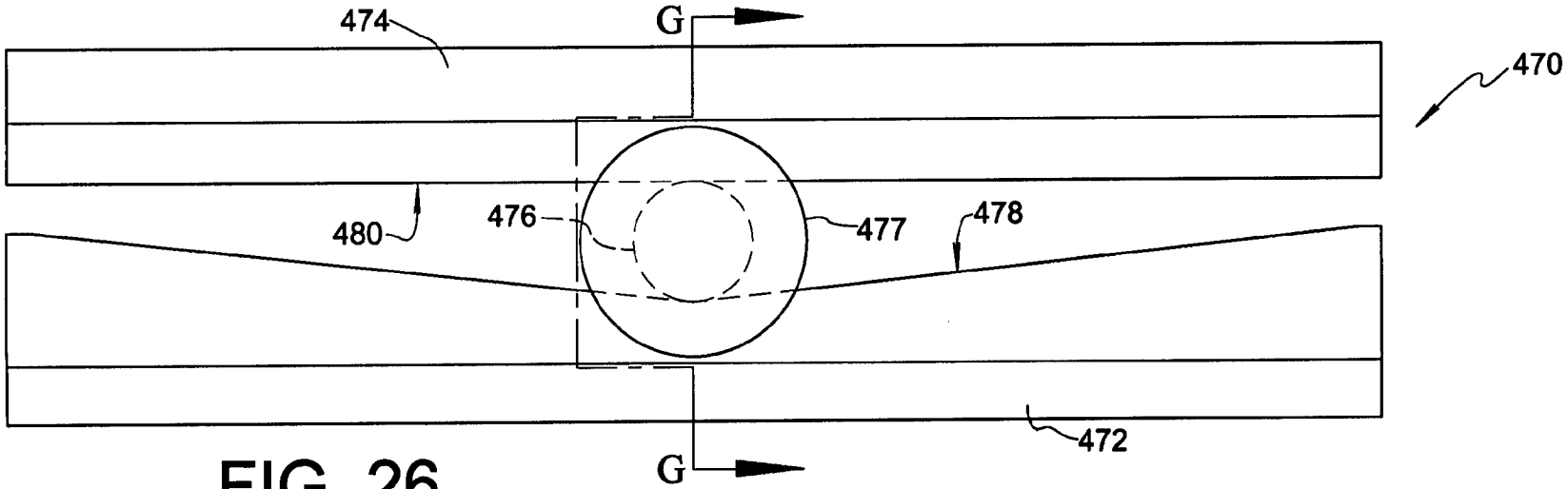
FIG. 26 is a side elevational view showing an isolation bearing of the present invention having a guide means for the roller according to a fourth guided roller embodiment.
Figure 27:
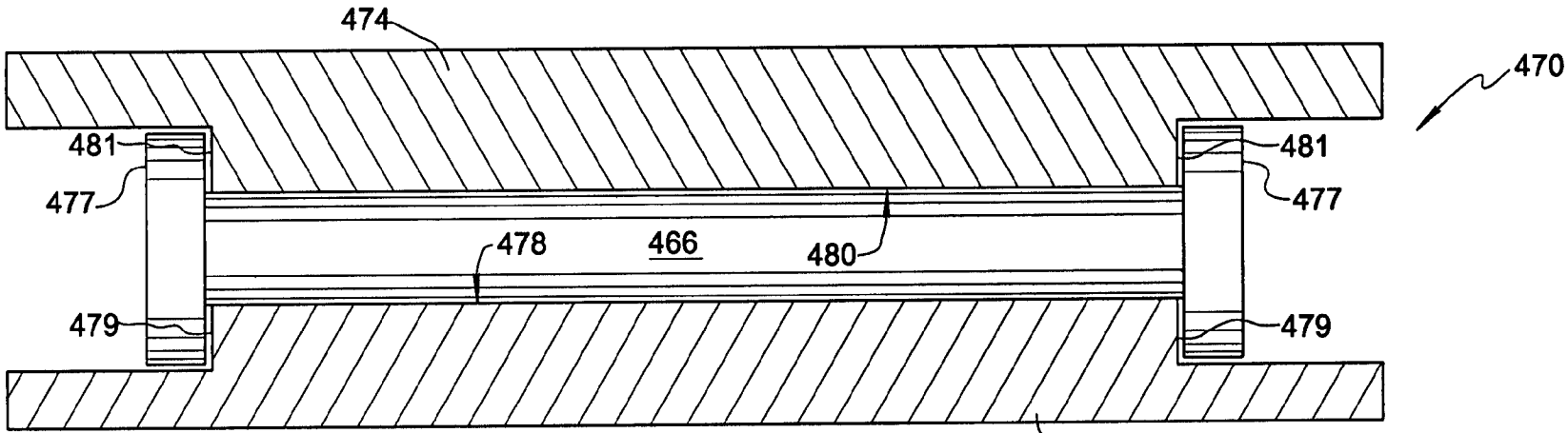
FIG. 27 is a cross-sectional view taken generally along the line G—G in FIG. 26.

Another guided roller embodiment is illustrated in FIGS. 26 and 27, wherein an isolation bearing 470 comprises a lower plate 472 having a V-shaped bearing surface 478, an upper plate 474 having a flat bearing surface 480, and a roller 476 in rolling contact with bearing surfaces 478 and 480. Roller 476 has a lateral configuration defined by a central, elongated cylindrical portion flanked by a pair of cylindrical end portions 477 of greater diameter than the central cylindrical portion. The lateral configuration of lower plate 472 includes steps 479 for engaging cylindrical end portions 477 to maintain alignment of roller 476 relative to the lower plate; likewise, upper plate 474 includes steps 481 for maintaining proper alignment of the roller relative to the upper plate.

Figure 28:
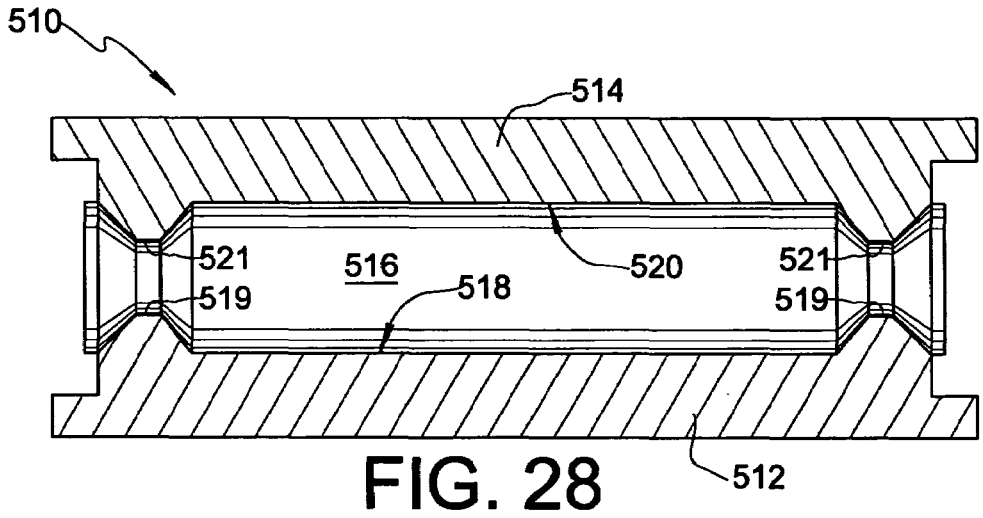
FIG. 28 is a cross-sectional view showing an isolation bearing of the present invention having a guide means for the roller according to a fifth guided roller embodiment.
Figure 29:
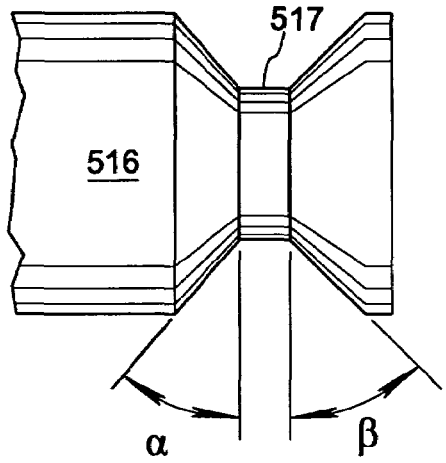
FIG. 29 is an enlarged view showing an end portion of the roller shown in FIG. 28.

FIG. 28 shows an isolation bearing 510 comprising a lower plate 512, and upper plate 514, and a roller 516 between an upwardly facing bearing surface 518 of the lower plate and a downwardly facing bearing surface of the upper plate. Although not visible from the view of FIG. 28, bearing surface 518 has a V-shaped profile similar to other embodiments previously described herein. Referring also to FIG. 29, roller 516 includes a groove 517 near each opposite end of the roller formed by an inner taper angle $\alpha$ and an outer taper angle $\beta$ leading to a radially reduced portion. Lower plate 512 includes parallel tracks 519 and upper plate 514 includes parallel tracks 521, wherein the tracks have a complementary configuration to register with grooves 517 of roller 516. As will be appreciated, taper angles $\alpha$ and $\beta$ can differ, whereby a gradual taper angle can be combined with a more abrupt taper angle to make use of both vertical and horizontal forces for guidance.

Figure 30:
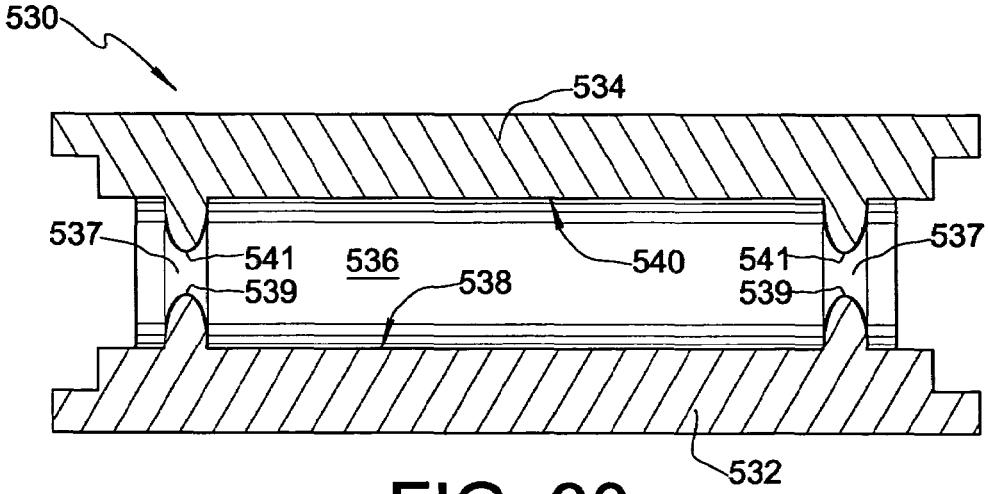
FIG. 30 is a cross-sectional view showing an isolation bearing of the present invention having a guide means for the roller according to a sixth guided roller embodiment.

FIG. 30 illustrates a seismic isolation bearing 530 comprising a lower plate 532, and upper plate 534, and a roller 536 between an upwardly facing bearing surface 538 of the lower plate and a downwardly facing bearing surface 540 of the upper plate. Although not visible from the view of FIG. 30, bearing surface 538 has a V-shaped profile similar to other embodiments previously described herein. Roller 536 includes a groove 537 near each opposite end of the roller, wherein the groove is characterized by a concave curvature in the lateral direction as seen in FIG. 30. Lower plate 532 includes parallel tracks 539 and upper plate 534 includes parallel tracks 541, wherein the tracks have a complementary convex configuration to register with concave grooves 537 of roller 536.

Figure 31:
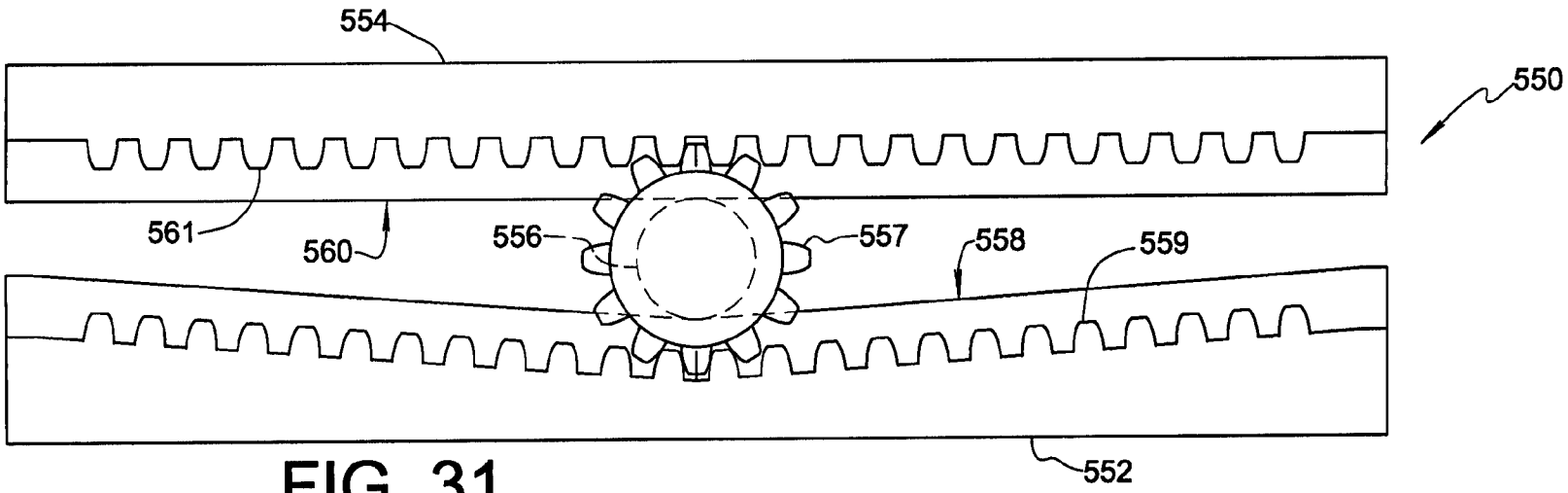
FIG. 31 is a side elevational view showing an isolation bearing of the present invention having a guide means for the roller according to a seventh guided roller embodiment.
Figure 32:
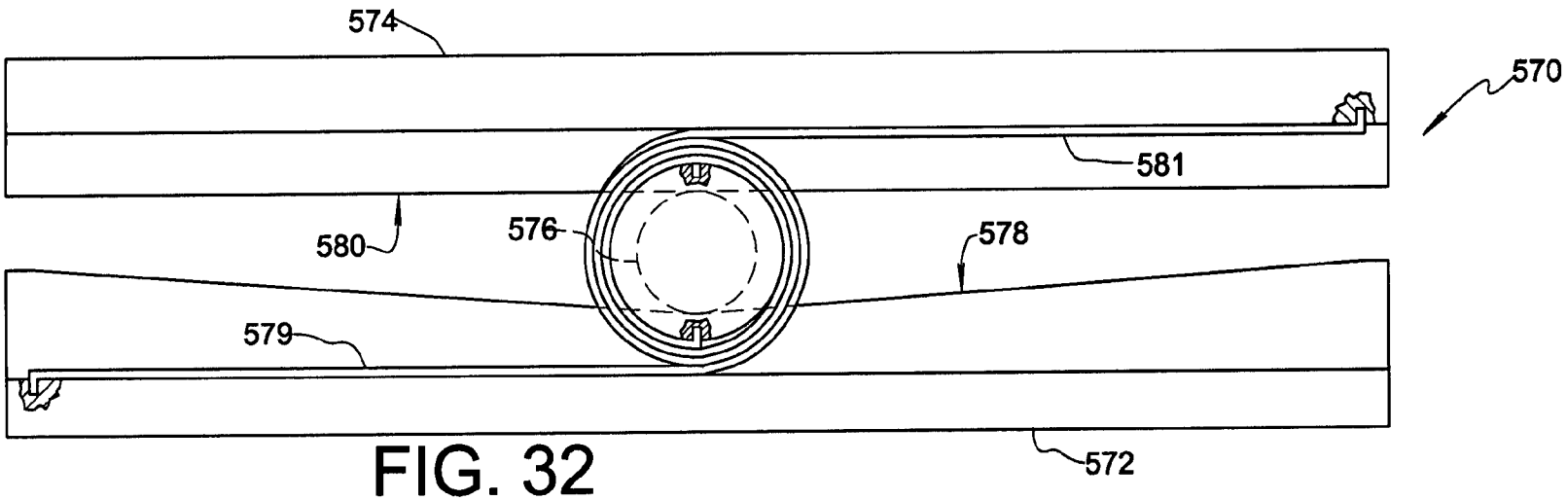
FIG. 32 is a side elevational view showing an isolation bearing of the present invention having a guide means for the roller according to an eighth guided roller embodiment.
Figure 33:
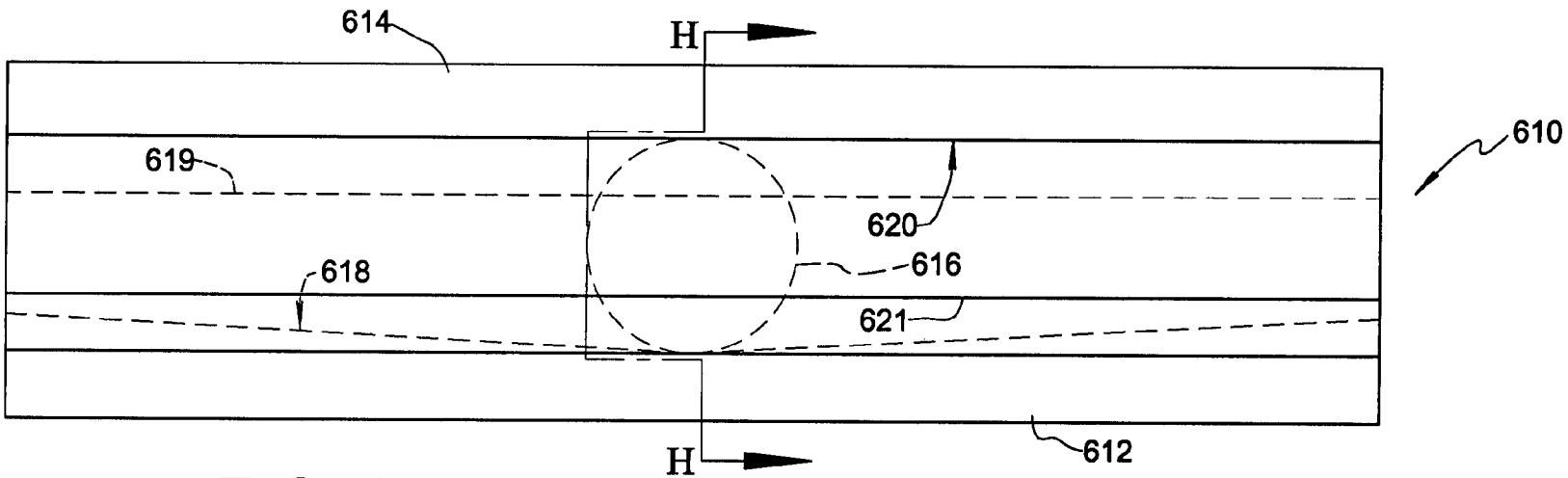
FIG. 33 is a side elevational view showing an isolation bearing of the present invention having a guide means for the roller according to a ninth guided roller embodiment.
Figure 34:
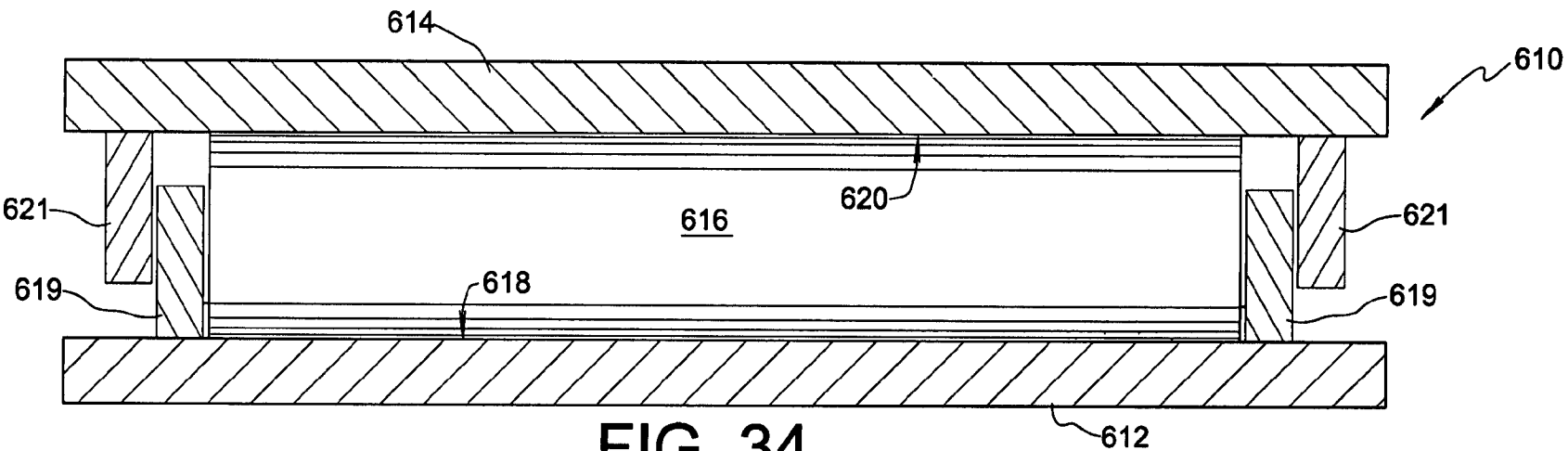
FIG. 34 is a cross-sectional view taken generally along the line H—H in FIG. 33.

Further means for guiding a roller in a seismic isolation bearing are illustrated in FIGS. 31 and 32. The guidance means in FIGS. 31 and 32 operate by synchronizing the angular displacement of the roller at each opposite end thereof. FIG. 31 shows an isolation bearing 554 comprising a lower plate 552 having an upwardly facing bearing surface 558 of V-shaped profile, an upper plate 554 having a downwardly facing bearing surface 560 that is flat in profile, and a roller 556 in rolling contact with bearing surfaces 558 and 560. Each end of roller 556 includes a pinion 557 operatively engaging an associated toothed rack 559 on lower plate 552 and an associated toothed rack 561 on upper plate 554 (only one end being visible in the view of FIG. 31). As a result, both ends of the roller 556 are confined to rotate in synchronized fashion to keep the roller on a linear path relative to the plates. FIG. 32 illustrates another arrangement based on the concept of synchronization. An isolation bearing 570 comprises lower and upper plates 572 and 574 having respective bearing surfaces 578 and 580, wherein bearing surface 578 has a V-shaped profile and bearing surface 580 is flat. At each end of roller 576 is a flexible ribbon 579 having one end anchored to the roller and another end anchored to lower plate 579 such that a reel is created. In similar fashion, another flexible ribbon 581 is anchored to roller 576 and upper plate 574. Accordingly, with this arrangement at each end of roller 576, rotations of the roller ends is synchronized.

The guided roller embodiments of FIGS. 20–32 involve guide means acting between the roller and the lower plate, and between the roller and the upper plate. However, it is also possible to have guide means acting between the roller and one of the plates, and between the one plate and the other plate. This approach is embodied in isolation bearing 610 of FIGS. 33 and 34. Isolation bearing 610 generally comprises a lower plate 612 having a bearing surface 618 that is V-shaped in profile, an upper plate 614 having a flat bearing surface 620, and a cylindrical roller 616 in rolling contact with the bearing surfaces. Roller 616 is guided with respect to lower plate 612 by a pair of parallel sidewall members 619 fixed to the lower plate and extending in a travel axis direction of the bearing. The inner surface of each sidewall member is in close facing proximity to an associated end of roller 616 to keep the roller in a constant orientation relative to the lower plate. As can be understood, the gaps between the ends of roller 616 and the sidewall surface, and the diameter of roller 616, must be chosen to prevent self-locking of the roller if the roller begins to rotate about a vertical axis relative to the lower plate (if the gaps are too large, and/or the roller diameter is too small, the roller can become wedged between the sidewalls at an angle). Upper plate 614 is guided with respect to lower plate 612 by a pair of sidewall members 621 externally adjacent and slidable relative to sidewall members 619. The depicted embodiment is a simplified case wherein sidewall members 619 and 621 can slide relative to one another both horizontally and vertically, preferably with a lubricant therebetween to decrease friction. Other friction reducing means may be used, such as ball bearings, provided they are mounted so as to allow both horizontal and vertical relative motion.

Figure 35:
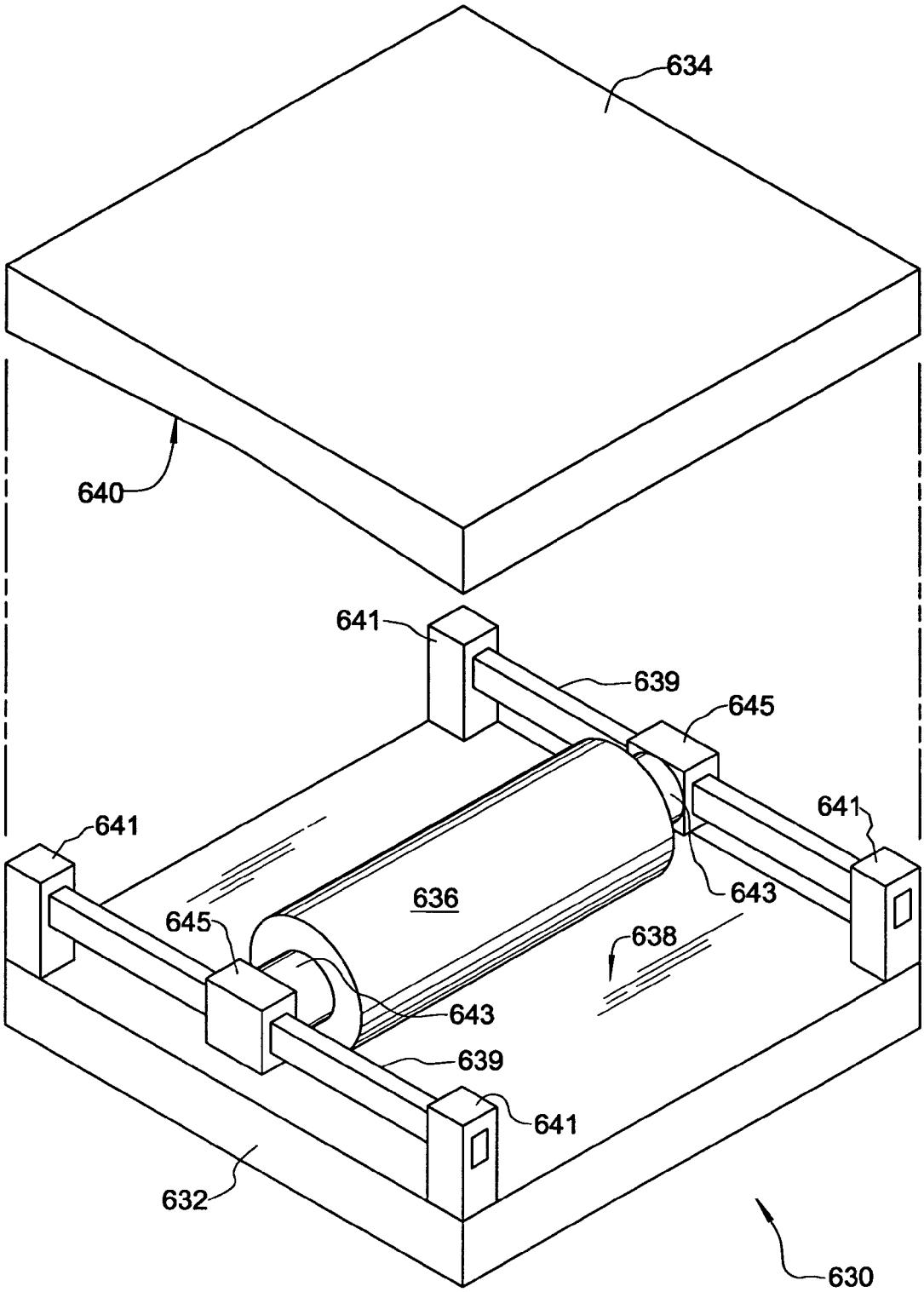
FIG. 35 is a partially exploded perspective view showing an isolation bearing of the present invention having a guide means for the roller according to a tenth guided roller embodiment.

The exploded view of FIG. 35 shows a further guided roller embodiment of the present invention. Seismic isolation bearing 630 comprises a lower plate 632, an upper plate 634, and a roller 636. The roller 636 is a cylindrical roller arranged in rolling contact with a flat bearing surface 638 of lower plate 632 and a V-shaped bearing surface 640 of upper plate 634, and is guided relative to lower plate 632 by parallel rails 639 mounted on lower plate 632 by supports 641 to extend parallel to a travel axis of the bearing. More specifically, a pair of rotary bearings 643 are mounted one at each opposite end of roller 636, and each rotary bearing carries a follower 645 having a channel through which an associated rail 639 extends.

Various embodiments of the present invention have been described with reference to figures showing the lower and upper plates, and the rollers, as being manufactured from a single piece of stock material. However, for manufacturing efficiency, these can of course be constructed of assembled constituent parts.

It will be appreciated that the present invention finds utility in protecting and isolating buildings and bridges from earthquake forces. However, the present invention finds further utility in the isolation of "secondary systems" placed inside buildings. Examples of secondary systems are computer and digital storage systems, vulnerable equipment, sculptures and other works of art, etc. When an earthquake attacks, the building structure may amplify both the acceleration and the displacement. In addition, inside a building, overlarge displacement of secondary systems is often not allowed. Therefore, in this case, both the absolute acceleration and the bearing displacement need to be reduced. This is in contrast to the case of bridge isolation, where the reduction of absolute acceleration is not a problem, but rather the base shear of bridge piers and abutments needs to be considered. In secondary system isolation, the problem of base share can often be ignored, and the goal is to reduce both the absolute acceleration of the superstructure and the bearing displacement.

What is claimed is:

1. An isolation bearing for supporting a superstructure relative to a base, said isolation bearing comprising:

an isolation axis;

a lower plate adapted for attachment to said base, said lower plate having an upwardly facing bearing surface;

an upper plate adapted for attachment to said superstructure, said upper plate having a downwardly facing bearing surface;

a pair of sidewall members fixed to said lower plate to define a pair of opposing wall surfaces extending parallel to said isolation axis of said bearing;

a roller situated between and in rolling contact with said upwardly facing bearing surface of said lower plate and said downwardly facing bearing surface of said upper plate;

at least one of said upwardly facing bearing surface and said downwardly facing bearing surface being configured to provide a normal reference position of said roller along said isolation axis toward which said roller is biased under gravitational loading; and non-linear damping means for providing a damping force for dissipating kinetic energy associated with displacement of said lower plate relative to said upper plate along said isolation axis, said damping force being a non-linear function of the velocity of said lower plate relative to said upper plate.

2. An isolation bearing for supporting a superstructure relative to a base, said isolation bearing comprising:

an isolation axis;

a lower plate adapted for attachment to said base, said lower plate having an upwardly facing bearing surface;

an upper plate adapted for attachment to said superstructure, said upper plate having a downwardly facing bearing surface;

a roller situated between and in simultaneous rolling contact with both said upwardly facing bearing surface of said lower plate and said downwardly facing bearing surface of said upper plate, said roller having a rotational roller axis and a pair of opposite ends;

a pair of sidewall members fixed to said lower plate to define a pair of opposing wall surfaces extending parallel to said isolation axis, each of said pair of opposing wall surfaces facing a respective one of said pair of opposite ends of said roller;

guide means located at the ends of said roller and in contact with said pair of opposing wall surfaces of said sidewall members for maintaining said roller axis in perpendicular relationship to said isolation axis;

at least one of said upwardly facing bearing surface and said downwardly facing bearing surface being configured to provide a normal reference position of said roller along said isolation axis toward which said roller is biased under gravitational loading; and non-linear damping means for providing a damping force for dissipating kinetic energy associated with displacement of said lower plate relative to said upper plate along said isolation axis, said damping force being a non-linear function of the velocity of said lower plate relative to said upper plate.

3. The apparatus according to claim 2, wherein said guide means is provided by said pair of opposite ends of said roller respectively arranged in surface-to-surface engagement with said pair of opposing wall surfaces of said sidewall members.

4. The apparatus according to claim 2, wherein said guide means is provided by a pair of sliding guides mounted one to each of said pair of opposite ends of said roller and respectively arranged in surface-to-surface engagement with said pair of opposing wall surfaces of said sidewall members.

5. The isolation bearing according to claim 2, wherein said upwardly facing bearing surface has a generally V-shaped profile.

6. The isolation bearing according to claim 2, wherein said pair of sidewall members are designed to withstand a lateral load equal to or greater than the vertical load supported by said isolation bearing.

7. The isolation bearing according to claim 2, wherein at least one of said pair of sidewall members is fixed to said lower plate in a releasable manner to enable relief of said frictional force.

8. The isolation bearing according to claim 2, further comprising a locking mechanism for preventing motion of said upper plate relative to said lower plate along said isolation axis incident to horizontal loading below a predetermined threshold.

9. The isolation bearing according to claim 8, wherein said locking mechanism allows a limited range of motion of said upper plate relative to said lower plate along said isolation axis prior to locking.

10. The isolation bearing according to claim 8, wherein said locking mechanism comprises:

a first member fixed relative to said upper plate, said first member having a pin hole therethrough;

a second member fixed relative to said lower plate, said second member having an elongated travel slot proximately overlapping with said pin hole; and a locking pin extending through said pin hole and said travel slot.

11. The isolation bearing, according to claim 10, wherein said locking pin includes a coupled nut and bolt.

12. The isolation bearing according to claim 8, wherein at least one of said pair of sidewall members includes a threaded hole extending therethrough, and said locking mechanism comprises a bolt extending through said threaded hole for engaging said upper plate to provide a frictional locking force that is adjustable.

13. The isolation bearing according to claim 2, wherein said non-linear damping means includes a linear spring having one end connected to said lower plate and another end connected to said upper plate.

14. The isolation bearing according to claim 13, wherein said linear spring includes means for adjusting a spring constant thereof.

15. The isolation bearing according to claim 2, wherein said non-linear damping means includes a nonlinear spring having one end connected to said lower plate and another end connected to said upper plate.

16. The isolation bearing according to claim 15, wherein said nonlinear spring is a hardening spring.

17. The isolation bearing according to claim 16, wherein said hardening spring includes an initial dead zone wherein there is no spring force associated with displacement of said upper plate relative to said lower plate, and a secondary dead zone after said primary dead zone wherein said spring force increases linearly with displacement of said upper plate relative to said lower plate.

18. The isolation bearing according to claim 2, wherein said roller is a cylindrical roller having a pair of opposite ends respectively facing said pair of opposing wall surfaces, and said non-linear damping means comprises a sliding guide carried at one of said opposite ends of said cylindrical roller for engaging a respective one of said pair of opposing wall surfaces for providing frictional force.

19. The isolation bearing according to claim 18, wherein said non-linear damping means comprises a pair of sliding guides carried one at each opposite end of said cylindrical roller for respectively engaging said pair of opposing wall surfaces for providing frictional force.

20. The isolation bearing according to claim 19, wherein each of said pair of sidewall members includes a friction track removably attached thereto for defining said pair of opposing wall surfaces, whereby the coefficient of friction between said sliding guides and said wall surfaces is selectable by installing suitable friction tracks.

21. The isolation bearing according to claim 19, wherein each of said pair of sliding guides includes a friction plate removeably attached thereto, whereby the coefficient of friction between said sliding guides and said wall surfaces is selectable by installing suitable friction plates.

22. An isolation bearing for supporting a superstructure relative to a base, said isolation bearing comprising:

an X isolation axis and a Y isolation axis orthogonal to said X isolation axis;

a lower plate adapted for attachment to said base, said lower plate having an upwardly facing bearing surface;

an interftiediate plate having a downwardly facing bearing surface and an upwardly facing bearing surface;

an upper plate adapted for attachment to said superstructure, said upper plate having a downwardly facing bearing surface;

a lower roller situated between and in simultaneous rolling contact with both said upwardly facing bearing surface of said lower plate and said downwardly facing bearing surface of said intermediate plate, said lower roller having a rotational roller axis and a pair of opposite ends;

a pair of lower sidewall members fixed to said lower plate to define a pair of opposing wall surfaces extending parallel to said X isolation axis, each of said pair of opposing wall surfaces of said lower sidewall members facing a respective one of said pair of opposite ends of said lower roller;

an upper roller situated between and in simultaneous rolling contact with both said upwardly facing bearing surface of said intermediate plate and said downwardly facing bearing surface of said upper plate, said upper roller having a rotational roller axis and a pair of opposite ends;

a pair of upper sidewall members fixed to said upper plate to define a pair of opposing wall surfaces extending parallel to said Y isolation axis, each of said pair of opposing wall surfaces of said upper sidewall members facing a respective one of said pair of opposite ends of said upper roller;

lower guide means located at the ends of said lower roller and in contact with said pair of opposing wall surfaces of said lower sidewall members for maintaining said axis of said lower roller in perpendicular relationship to said X isolation axis;

upper guide means located at the ends of said upper roller and in contact with said pair of opposing wall surfaces of said upper sidewall members for maintaining said axis of said upper roller in perpendicular relationship to said Y isolation axis;

at least one of said upwardly facing bearing surface of said lower plate and said downwardly facing bearing surface of said intermediate plate being configured to provide a normal reference position of said lower roller along said X isolation axis toward which said lower roller is biased under gravitational loading; and at least one of said upwardly facing bearing surface of said intermediate plate and said downwardly facing bearing surface of said upper plate being configured to provide a normal reference position of said upper roller along said Y isolation axis toward which said upper roller is biased under gravitational loading.

23. The isolation bearing according to claim 22, wherein said lower roller and said upper roller are subjected to restorative biasing forces of different magnitudes for biasing said lower roller and said upper roller toward their respective axial reference positions.

24. The isolation bearing according to claim 23, wherein said downwardly facing bearing surface of said intermediate plate has an inverted generally V-shaped profile that is symmetrical about said reference position along said X isolation axis and is characterized by a first slope angle, said upwardly facing bearing surface of said intermediate plate has a generally V-shaped profile that is symmetrical about said reference position along said Y isolation axis and is characterized by a second slope angle, and said first and second slope angles differ in magnitude.

25. The isolation bearing according to claim 22, further comprising non-linear damping means for providing an X axis damping force for dissipating kinetic energy associated with displacement of said lower plate relative to said intermediate plate along said X isolation axis and a Y axis damping force for dissipating kinetic energy associated with displacement of said intermediate plate relative to said upper plate along said Y isolation axis, said X axis damping force being a non-linear function of the velocity of said lower plate relative to said intermediate plate and said Y axis damping force being a non-linear function of the velocity of said intermediate plate relative to said upper plate.

26. The isolation bearing according to claim 25, wherein said lower roller and said upper roller are cylindrical rollers, and said non-linear damping means includes:

a pair of sliding guides carried one at each opposite end of said lower cylindrical roller for respectively engaging said pair of opposing wall surfaces defined by said pair of lower sidewall members for providing frictional force opposing relative motion between said lower roller and said pair of lower sidewall members; and a pair of sliding guides carried one at each opposite end of said upper cylindrical roller for respectively engaging said pair of opposing wall surfaces defined by said pair of upper sidewall members for providing frictional force opposing relative motion between said upper roller and said pair of upper sidewall members.

27. The isolation bearing according to claim 26, wherein said downwardly facing bearing surface of said intermediate plate has an inverted generally V-shaped profile and said upwardly facing bearing surface of said intermediate plate has a generally V-shaped profile.

28. The isolation bearing according to claim 26, wherein each of said pair of lower sidewall members includes a respective friction track removably attached thereto for defining said pair of opposing wall surfaces, whereby the coefficient of friction between said sliding guides associated with said lower roller and said wall surfaces defined by said lower sidewall members is selectable by installing suitable friction tracks.

29. The isolation bearing according to claim 26, wherein each of said pair of upper sidewall members includes a respective friction track removably attached thereto for defining said pair of opposing wall surfaces, whereby the coefficient of friction between said sliding guides associated with said upper roller and said wall surfaces defined by said upper sidewall members is selectable by installing suitable friction tracks.

30. The isolation bearing according to claim 26, wherein each of said pair of sliding guides associated with said lower roller includes a friction plate removeably attached thereto, whereby the coefficient of friction between said sliding guides associated with said lower roller and said wall surfaces defined by said lower sidewall members is selectable by installing suitable friction plates.

31. The isolation bearing according to claim 26, wherein each of said pair of sliding guides associated with said upper roller includes a friction plate removeably attached thereto, whereby the coefficient of friction between said sliding guides associated with said upper roller and said wall surfaces defined by said upper sidewall members is selectable by installing suitable friction plates.

32. The isolation bearing according to claim 26, wherein said frictional force associated with said sliding guides carried by said lower roller differs from said frictional force associated with said sliding guides carried by said upper roller.

33. The isolation bearing according to claim 26, further comprising a locking mechanism for preventing motion of said intermediate plate relative to said lower plate along said X isolation axis incident to loading directed along said X isolation axis below a predetermined X axis threshold and for preventing motion of said intermediate plate relative to said upper plate along said Y isolation axis incident to loading directed along said X isolation axis below a predetermined Y axis threshold.

34. The isolation bearing according to claim 33, wherein said locking mechanism is independently releasable with respect to said X isolation axis and with respect to said Y isolation axis.

35. The isolation bearing according to claim 34, wherein at least one of said pair of lower sidewall members includes a threaded hole extending therethrough, and said locking mechanism comprises a bolt extending through said threaded hole for engaging said intermediate plate to provide a frictional locking force that is adjustable.

36. The isolation bearing according to claim 34, wherein at least one of said pair of upper sidewall members includes a threaded hole extending therethrough, and said locking mechanism comprises a bolt extending through said threaded hole for engaging said intermediate plate to provide a frictional locking force that is adjustable.

37. The isolation bearing according to claim 25, wherein said non-linear damping means includes:

at least one X-axis spring having one end connected to said lower plate and another end connected to said intermediate plate, said X-axis spring being aligned to act in a direction parallel to or coincident with said X isolation axis; and at least one Y-axis spring having one end connected to said intermediate plate and another end connected to said upper plate, said Y-axis spring being aligned to act in a direction parallel to or coincident with said Y isolation axis.

38. The isolation bearing according to claim 37, wherein said at least one X-axis spring includes a linear spring and said at least one Y-axis spring includes a linear spring.

39. The isolation bearing according to claim 37, wherein said at least one X-axis spring includes a hardening spring and said at least one Y-axis spring includes a hardening spring.

40. A, seismically isolated structure comprising:

an isolation axis;

a base;

an upwardly facing bearing surface fixed relative to said base;

a superstructure;

a downwardly facing bearing surface fixed relative to said superstructure;

a roller situated between and in rolling contact with said upwardly facing bearing surface and said downwardly facing bearing surface;

at least one of said upwardly facing bearing surface and said downwardly facing bearing surface being configured to provide a normal reference position of said roller along said isolation axis toward which said roller is biased under gravitational loading; and non-linear damping means for providing a damping force for dissipating kinetic energy associated with displacement of said base relative to said superstructure along said isolation axis, said damping force being a non-linear function of the velocity of said base relative to said superstructure.

41. The seismically isolated structure according to claim 40, wherein said non-linear damping means includes means for frictional damping.

42. The isolation bearing according to claim 40, wherein said non-linear damping means includes a visco-elastic damper.

43. The isolation bearing according to claim 40, wherein said non-linear damping means includes a linear spring.

44. The isolation bearing according to claim 43, wherein said linear spring includes means for adjusting a spring constant thereof.

45. The isolation bearing according to claim 40, wherein said non-linear damping means includes a nonlinear spring.

46. The isolation bearing according to claim 45, wherein said nonlinear spring is a hardening spring.

47. An isolation bearing for supporting a superstructure relative to a base, said isolation bearing comprising:

an isolation axis;

a lower plate adapted for attachment to said base, said lower plate having an upwardly facing bearing surface;

an upper plate adapted for attachment to said superstructure, said upper plate having a downwardly facing bearing surface;

a roller situated between and in simultaneous rolling contact with both said upwardly facing bearing surface of said lower plate and said downwardly facing bearing surface of said upper plate, said roller having a rotational roller axis and a pair of opposite ends;

a pair of sidewall members fixed to said lower plate to define a pair of opposing wall surfaces extending parallel to said isolation axis, each of said pair of opposing wall surfaces facing a respective one of said pair of opposite ends of said roller; and guide means located at the ends of said roller and in contact with said pair of opposing wall surfaces of said sidewall members for maintaining said roller axis in perpendicular relationship to said isolation axis;

wherein at least one of said upwardly facing bearing surface and said downwardly facing bearing surface is a cylindrical surface.

48. The isolation bearing according to claim 47, wherein one of said upwardly facing bearing surface and said downwardly facing bearing surface is a cylindrical surface, and the other of said upwardly facing bearing surface and said downwardly facing bearing surface has a generally V-shaped profile.

49. The isolation bearing according to claim 48, wherein said generally V-shaped profile is characterized by a smoothly curved transition zone across an imaginary vertex of said generally V-shaped profile, wherein said transition zone has a radius of curvature that is greater than a radius of said roller.

50. The isolation bearing according to claim 49, wherein said transition zone is defined by a non-metallic damping insert.

51. The isolation bearing according to claim 50, wherein said damping insert is fonned of rubber or viscoelastic material.

52. An isolation bearing for supporting a superstructure relative to a base, said isolation bearing comprising:

a lower plate adapted for attachment to said base, said lower plate having an upwardly facing bearing surface;

an upper plate adapted for attachment to said superstructure, said upper plate having a downwardly facing bearing surface; and a roller situated between and in rolling contact with said upwardly facing bearing surface of said lower plate and said downwardly facing bearing surface of said upper plate;

wherein at least one of said upwardly facing bearing surface and said downwardly facing bearing surface has a generally V-shaped profile characterized by a smoothly curved transition zone across an imaginary vertex of said generally V-shaped profile, said transition zone having a radius of curvature that is greater than a radius of said roller.

53. The isolation bearing according to claim 52, wherein said transition zone is defined by a non-metallic damping insert.

54. The isolation bearing according to claim 53, wherein said damping insert is formed of rubber or viscoelastic material.

55. The isolation bearing according to claim 53, wherein one of said upwardly facing bearing surface and said downwardly facing bearing surface has said generally V-shaped profile, and the other of said upwardly facing bearing surface and said downwardly facing bearing surface has a flat profile.

56. The isolation bearing according to claim 52, wherein one of said upwardly facing bearing surface and said downwardly facing bearing surface has said generally V-shaped profile, and the other of said upwardly facing bearing surface and said downwardly facing bearing surface has a flat profile.

57. The isolation bearing according to claim 56, wherein said upwardly facing bearing surface is coated by a layer of damping material.

58. The isolation bearing according to claim 57, wherein an external surface of said roller is coated by a layer of damping material.

59. The isolation bearing according to claim 56, wherein said downwardly facing bearing surface is coated by a layer of damping material.

60. The isolation bearing according to claim 59, wherein an external surface of said roller is coated by a layer of damping material.

61. The isolation bearing according to claim 60, wherein said upwardly facing bearing surface is coated by a layer of damping material.

62. The isolation bearing according to claim 52, wherein both of said upwardly facing bearing surface and said downwardly facing bearing surface have a generally V-shaped profile characterized by a smoothly curved transition zone across an imaginary vertex, thereof, said transition zone having a radius of curvature that is greater than a radius of said roller.

63. The isolation bearing according to claim 62, wherein each said transition zone is defined by a non-metallic damping insert.

64. The isolation bearing according to claim 63, wherein each said damping insert is formed of rubber or viscoelastic material.

65. The isolation bearing according to claim 52, wherein an external surface of said roller is coated by a layer of damping material.

66. An isolation bearing for supporting a superstructure relative to a base, said isolation bearing comprising:

a lower plate having an upwardly facing bearing surface;

an upper plate having a downwardly facing bearing surface;

a roller situated between and in rolling contact with said upwardly facing bearing surface of said lower plate and said downwardly facing bearing surface of said upper plate, at least one of said upwardly facing bearing surface and said downwardly facing bearing surface having a generally V-shaped profile; and guide means for maintaining rolling motion of said roller relative to said upwardly facing bearing surface and rolling motion of said roller relative to said downwardly facing bearing surface along a common travel axis, wherein said roller has an axis of rotation extending laterally relative to said travel axis, and said guide means acts between said roller and one of said lower plate and said upper plate, and between said lower plate and said upper plate.

67. The isolation bearing according to claim 66, wherein said guide means comprises a pair of sidewalls fixed to said one of said lower plate and said upper plate, each of said pair of sidewalls extending parallel to said travel axis, and said roller is located between said pair of side walls such that each opposite end of said roller is proximate to a respective one of said pair of sidewalls.

68. An isolation bearing for supporting a superstructure relative to a base, said isolation bearing comprising:

an isolation axis;

a lower plate having an upwardly facing bearing surface;

an upper plate having a downwardly facing bearing surface;

a roller situated between and in simultaneous rolling contact with both said upwardly facing bearing surface of said lower plate and said downwardly facing bearing surface of said upper plate, said roller having a rotational roller axis and a pair of opposite ends;

a pair of sidewall members fixed to said lower plate to define a pair of opposing wall surfaces extending parallel to said isolation axis, each of said pair of opposing wall surfaces facing a respective one of said pair of opposite ends of said roller;

one of said upwardly facing bearing surface and said downwardly facing bearing surface having a generally V-shaped profile and the other of said upwardly facing bearing surface and said downwardly facing bearing surface having a flat profile; and guide means located at the ends of said roller and in contact with said pair of opposing wall surfaces of said sidewall members for maintaining said roller axis in perpendicular relationship to said isolation axis.

* * * * *